US005462649A

United States Patent [19]

Keeney et al.

[11] Patent Number: 5,462,649

[45] Date of Patent: Oct. 31, 1995

[54] METHOD AND APPARATUS FOR ELECTROLYTIC PLATING

[75] Inventors: Harold M. Keeney, Whitehall; Erik S. Van Anglen, Quakertown; James L. Forand, Whitehall, all of Pa.

[73] Assignee: Electroplating Technologies, Inc., Northampton, Pa.

[21] Appl. No.: 179,520

[22] Filed: Jan. 10, 1994

[51] Int. Cl.[6] ..... C25D 5/22

[52] U.S. Cl. ..... 205/93; 205/151; 204/217; 204/272; 204/279

[58] Field of Search ..... 205/93, 117, 151; 204/217, 227, 232, 272, 279

[56] References Cited

U.S. PATENT DOCUMENTS

| | | | |
|---|---|---|---|
| 1,473,060 | 11/1923 | Taylor | 205/93 |
| 1,494,152 | 5/1924 | Cowper-Coles | 205/73 |
| 3,715,299 | 2/1973 | Anderson et al. | 204/212 |
| 4,235,691 | 11/1980 | Loqvist | 204/212 |
| 4,399,019 | 8/1983 | Kruper et al. | 204/212 |
| 5,277,785 | 1/1994 | Van Anglen | 205/117 |

OTHER PUBLICATIONS

S. Eisner, "Electroplating Accompanied by Controlled Abrasion of the Plate" *Plating*, Oct., 1971.

*Primary Examiner*—Kathryn Gorgos
*Assistant Examiner*—Brendan Mee
*Attorney, Agent, or Firm*—Charles A. Wilkinson

[57] ABSTRACT

A resilient dielectric wiper blade is mounted between a cathodic workpiece and an anode to wipe bubbles of hydrogen from the surface, sever dendritic material, if such is present as the coating thickens, and to remove a surface layer of partially depleted electrolytic solution and replace with fresh solution. The resilient dielectric wiper blade is preferably used with perforated anodes.

35 Claims, 9 Drawing Sheets

Fig. 1
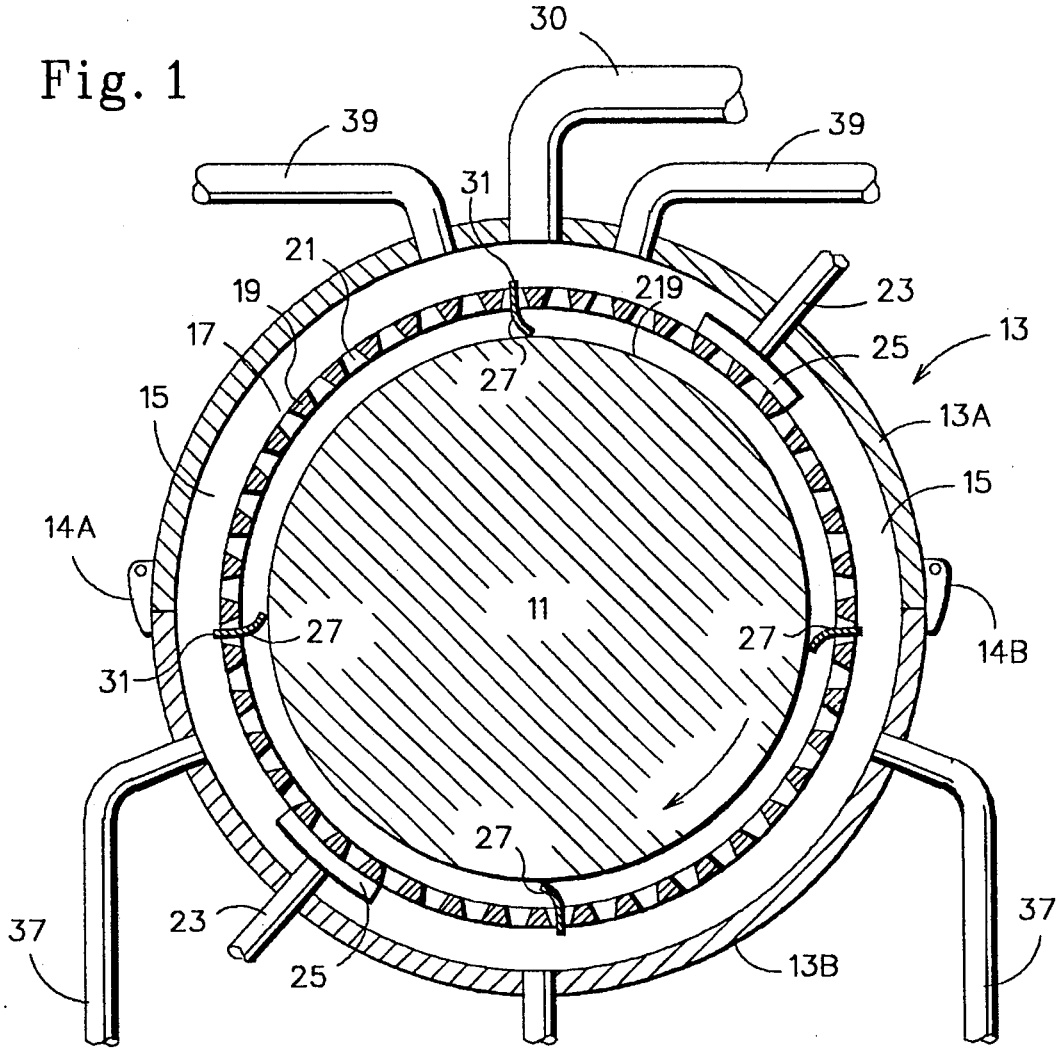
Fig. 2
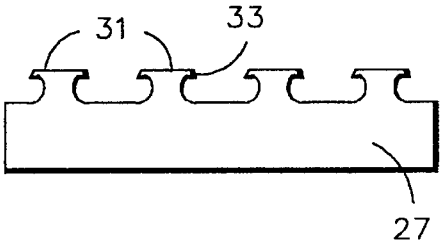
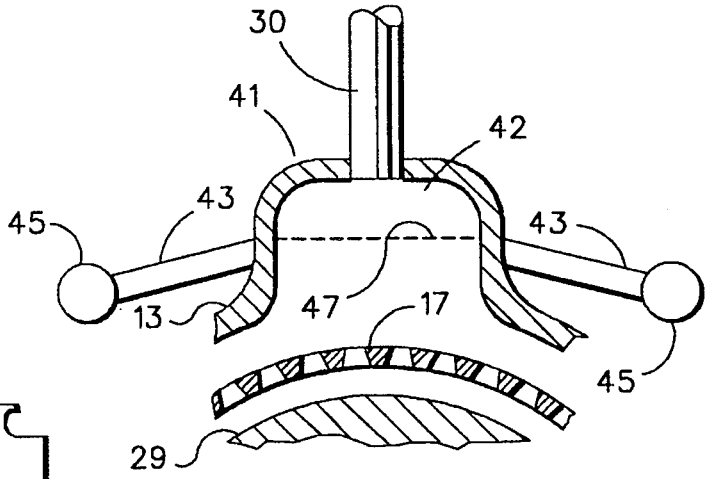
Fig. 1A 121A
121B
122A
122B
123
125
125A
125B
126
131
133
135
137
171
173
175
X
X Fig. 21
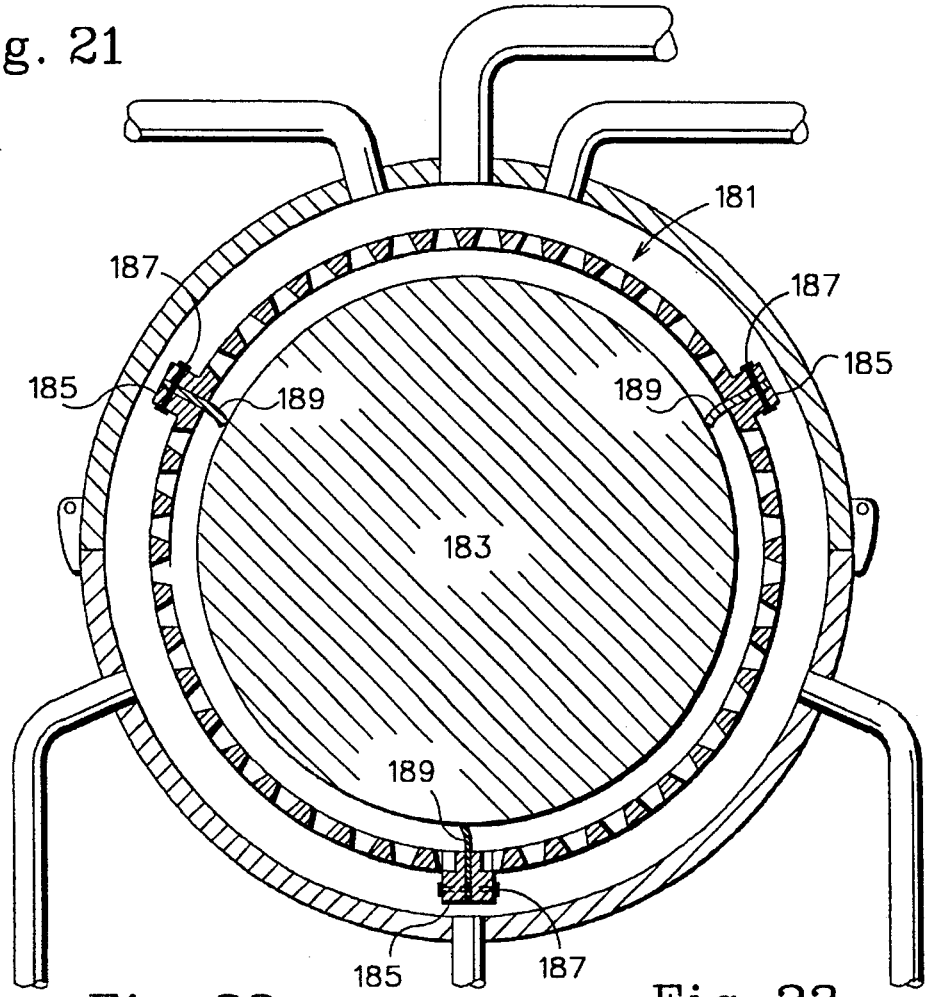
Fig. 22
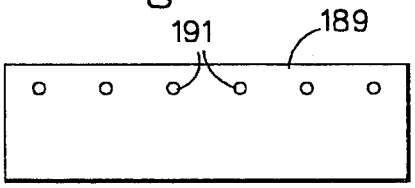
Fig. 23
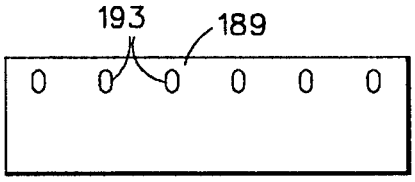
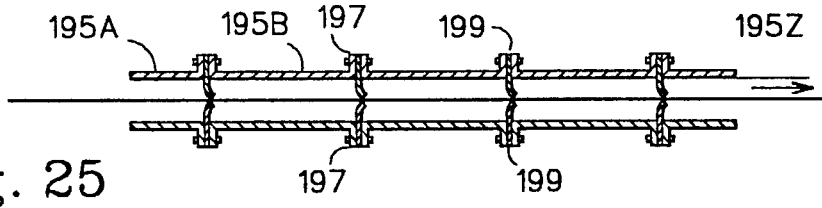
Fig. 24
Fig. 25
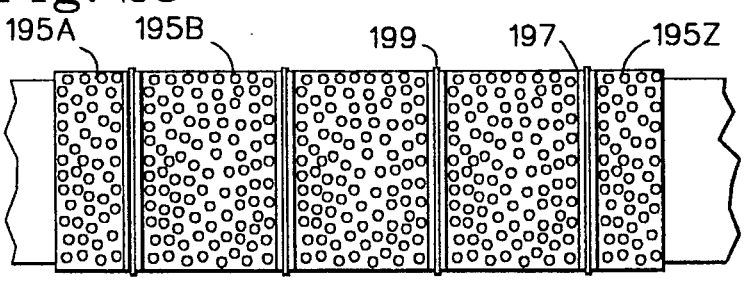
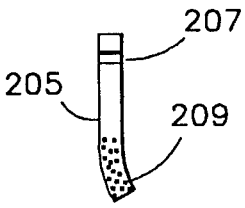
Fig. 26

METHOD AND APPARATUS FOR ELECTROLYTIC PLATING

RELATED APPLICATIONS

This application is related to, but not dependent upon a simultaneously filed continuation-in-part application disclosing in part related apparatus, which related application is a continuation-in-part of U.S. application Ser. No. 07/915,455, from which no priority is claims with respect to the present application.

BACKGROUND OF THE INVENTION (1) Field of the Invention

This invention relates to the deposition of metallic coatings from plating solutions. More particularly, this invention relates to wiping the cathodic coating surface during electrolytic coating and particularly to the use of a substantially solid wiper blade during such coating.

(2) Prior Art

A number of coatings are deposited from so-called plating baths in which a coating solution is subjected to an imposed electrical potential. Such imposed electrical potential basically enhances an already naturally occurring tendency for any metal ions in solution to deposit, or plate out, upon any metal object or surface immersed within or partially within the solution. Such metal surfaces are, under favorable conditions, able to supply electrons to metallic ions dissolved in the solution, converting such ions to less soluble metallic atoms which are deposited upon the electron donor material. This natural deposition, or plating out, of the coating material from a natural solution is invariably rather slow or, in many cases, even more than counterbalanced by simultaneously proceeding resolution processes. However, such natural deposition or plating rate can be improved dramatically by application of an external electrical potential to a plating bath, in effect causing a current to flow through, or partially through, the bath. The individual electrons of such current derived from the cathode combine with metallic ions in the coating bath adjacent to the cathode and rapidly convert such dissolved metal ions to metal atoms which deposit or plate out as a coating on the cathode from which the electrons are derived. Such externally applied current also more quickly forms metallic ions at the anode when a soluble anode is used, which ions dissolve into the coating bath to take the place of other ions deposited or plated out as a metal layer upon the cathode or other adjacent materials. So-called "electrolytic coating" using electrolytic coating baths is very widely used, both on a small scale and very large scale, for production-type coating of various products in large and small scale facilities.

Since the coating of a cathodic workpiece is largely merely the acceleration of a naturally occurring process or phenomena, fairly small changes in technique and apparatus accentuating those conditions that favor deposition and de-emphasizing these conditions that disfavor deposition, may have rather large effects upon the final coating obtained. The history of improvements in the field, therefore, is largely one of progressive small improvements and adjustments to improve the conditions for deposition of various coating metals on a metallic substrate temporarily included as the cathode in a plating circuit.

It has been found, for example, by the present inventors and others that it is conducive to good coating results to remove the hydrogen bubbles which are produced in an electrolytic solution at the cathodic work surface. Such bubbles are formed by transfer of electrons not only to the positive ions of the coating metal in the solution, but also to positive hydrogen ions in the electrolytic solution. Such positive hydrogen ions are derived from dissociated water, some ionization of which is always present in an aqueous solution, but which ionization is increased by the polarization of the water in the electrical field of an active electrolytic coating bath. The hydrogen collects initially as a thin cathodic film on the surface of the work and then with continued evolution of hydrogen tends to coalesce into macroscopically visible bubbles of hydrogen. The initial cathodic film is believed to be a combination or mixture of both hydrogen ions and atomic hydrogen. The thin cathodic film of hydrogen collecting upon the work surface, which film initially is only one atom thick, interferes to some extent with good coating in that it may tend to hold the larger metallic coating ions away from the surface. However, the hydrogen atoms are small and the layer of hydrogen is initially discontinuous so that their initial interference with coating is not too serious. In other words, it is relatively easy for a larger metallic ion to work its way in among the hydrogen. However, as more hydrogen is, in effect, precipitated out of the electrolyte onto the surface of the workpiece, interference with coating deposition by the hydrogen becomes greater and greater. In addition, the hydrogen tends to become incorporated into the coating itself both by having coating metal laid down about it and by migration through interatomic or intramolecular spaces into the coating metal and even into the base metal. It is well known that such interstitial hydrogen may, by straining the metallic space lattice, harden the metal, which may be advantageous in some cases, but is usually disadvantageous in that it may cause cracking.

If nothing is done to remove the hydrogen from the surface coating during the coating process, coating will usually continue, even though seriously interfered with by the hydrogen present, because such hydrogen as it accumulates tends to coalesce into larger local accumulations resulting in small bubbles and then larger and larger bubbles until such bubbles have sufficient volume and buoyancy to overcome their initial attraction for or clinging to the substrate surface and float upwardly in the solution to the surface to be finally dissipated in the surrounding atmosphere or local environment. Consequently, the hindrance caused by the presence of hydrogen gas at the surface of a cathodic workpiece does not tend to progress to the limit where it would cut off electrolytic plating completely. However, hydrogen is still a very significant hindrance to rapid coating or plating and the larger bubbles clinging to the surface of a workpiece may even lead to macroscopic pits and other defects in an electrolytic coating.

A second significant problem which has been long recognized in electrolytic coating baths is depletion of the electrolytic solution as coating progresses. In many cases, the only result is that the coating rate slows down due to there being progressively less coating metal ions in the solution to plate out. This has been counteracted by pumping in fresh coating solution, throwing in chunks of soluble coating metal for solution to "beef up" the electrolyte and other expedients. The trend has been to closer and closer control of the electrolyte composition during coating. Sometimes this has been implemented by continuous testing or analysis of the electrolytic bath as coating progresses. In addition, the coating solution baths have been mixed by impellers or the like, force circulated and re-circulated as well as frequently tested to hold them to a desired composition.

It has also been recognized that the coating bath next to a workpiece being coated may become locally depleted of coating metal ions and that such depletion may compromise efficient coating. Some installations have adopted the expedient of forced circulation of electrolyte past the point of coating or through a restricted coating area to increase the efficiency of coating. If the forced circulation is rapid enough, such circulation in itself also tends to detach bubbles of hydrogen from the cathodic coating surface, in effect, "killing two birds with one stone". However, the use of forced circulation of this type by pumps, jets and the like is not only unwieldy and expensive, but is believed by some to possibly have detrimental effects upon the coating itself because of the generalized rapidity of movement between the coating solution and cathodic workpiece, which macroscopically, at least, may interfere with efficient plating out of the metallic ions upon such work surface. Among the processes which have made use of rapid forced circulation is the so-called gap coating process in which a small coating gap between a coating anode and a cathodic workpiece is created and electrolytic solution is forced rapidly through such gap or opening.

Depletion of the coating solution has recently been found by one of the present inventors to be particularly serious in chrome plating solutions in which insoluble electrodes are used, since it has been found that unless the chromium plating operation is maintained substantially continuous and at a fairly uniform rate that hard chrome is difficult to efficiently plate out of a brush-type coating operation, or, for that matter, in semi-brush type operations. Additional details concerning the desirability of maintaining a constant electrolytic coating composition in the production of hard chrome coatings by brush plating are set forth in U.S. application Ser. No. 07/915,455 filed Jul. 16, 1992.

While various efforts to remove hydrogen bubbles from the coating surface in an electrolytic coating bath at the point of deposition have been tried, none has provided the ultimate quality of coating and efficiency of the coating operation which has been desired. Likewise, the ultimate in practical prevention of localized depletion in a coating bath has also not been attained. There has been a need, therefore, for a means for removing hydrogen bubbles and cathodic film from a cathodic coating surface as well as preventing localized depletion of the coating bath of coating material. The present applicants have found that a very effective means for accomplishing both these purposes is by the use of a relatively thin wiping blade applied to the surface of the workpiece at spaced intervals with a light contact. Such wiping blade deviates the relatively stable surface layer of electrolyte along a moving cathodic surface mixing and replenishing the electrolyte next to the cathodic surface. It also at the same time wipes or sweeps away bubbles of hydrogen as well as encourages coalescence of small bubbles and films of hydrogen into large bubbles for subsequent wiping away. Some of the more pertinent prior art patents related to the above noted problems and their solution are as follows.

U.S. Pat. No. 442,428 issued Dec. 9, 1890 to F. E. Elmore, discloses burnishing of the surface of a product being electroplated by impinging a burnishing implement against the surface being coated during the time coating deposition is proceeding. A core, mold or mandrel is mounted for rotation within a plating tank and a traveler arranged to move back and forth along the mandrel or the like as it rotates. The burnishing surface may be formed from agate, blood stone, flint or glass, in each case having a highly polished surface. These substances are characterized by Elmore as being non-conducting substances capable of burnishing and not acted upon by the coating electrolyte.

U.S. Pat. No. 817,419 issued Apr. 10, 1906 to O. Dieffenbach, discloses the use of comminuted kieselguhr in an electrolytic bath to act upon the surface of a workpiece during electrodeposition of metallic coatings. Dieffenbach mentions a previous German patent which added solid or liquid bodies to an electrolytic bath liquor which were able by impinging against a cathode, to remove small bubbles of hydrogen adhering to the workpiece or cathode as well as smoothing the metallic deposit. According to Dieffenbach, a previous German patent disclosed the use of sand, pumicestone, brick dust, wood flour, and chaff as impinging substances. Dieffenbach states that his kieselguhr has the advantage over these other substances of being "much harder and sharper edged so that it is capable of cutting up more readily" than the other substances, "the small bubbles of hydrogen that are deposited on the cathode". He also indicates that kieselguhr becomes strongly impregnated with the coating liquid so that its specific weight is "reduced".

U.S. Pat. No. 850,912 issued Apr. 23, 1907 to T. A. Edison, discloses that during the plating of iron, the formation of gas bubbles frequently results in the coating being pitted or even perforated. In order to avoid such pitting by the formation of gas bubbles, Edison introduces a quantity of crushed charcoal into the solution which, he states, "will rub over and scour the surface of the deposited metal to polish the same and wipe off any gas bubbles which may tend to accumulate thereupon".

U.S. Pat. No. 1,051,556 issued Jan. 28, 1913 to S. Consigliere, discloses the use of a number of small, non-conducting bodies having rounded edges within an electrolytic coating bath, which bodies roll and beat on the surface of the body or "mold" upon which the metallic layer is being deposited or has already been deposited while the electric current is turned on. Consigliere suggests the use of glass or porcelain balls, ordinary pebbles and the like. He calls these bodies "burnishing bodies".

U.S. Pat. No. 1,236,438 issued Aug. 14, 1917 to N. Huggins discloses an apparatus for densifying electro-deposited material in which a roller positioned above the surface of the coating bath impinges upon the surface of a round body being coated as such body rotates out of the bath and wherein the surface is electroplated as the body rotates again down into the bath. Huggins states that for various reasons still undiscovered, but with which most of those skilled in the art are familiar, the metal deposited by the electrolytic bath is frequently spongy and unevenly deposited. Huggins'rolling process is said to be effective in consolidating the spongy material as well as the various layers which are separately laid down as the ring or roll rotates in the bath.

U.S. Pat. No. 2,473,290 issued Jun. 14, 1949 to G. E. Millard discloses an electroplating apparatus for plating crankshafts and the like with chromium in which a curved anode partially surrounds the portion of the workpiece to be coated. The curved anode has orifices in its surfaces to allow the escape of bubbles formed during the coating process and also has extending through its surface, a support for a so-called positioning block or scraper block 54 which is provided to maintain a close spacing between the anode and cathodic workpiece. Millard states also that his spacing block removes gas bubbles from the cathode and also removes threads of chromium. He also states that the block, which has a significant width, dresses and polishes the cathode during plating. The aim of Millard, is clearly to burnish or compact the coating surface somewhat in the manner of the earlier Huggins patent. While Millard talks, therefore, about scraping off the gas bubbles and also removing "threads" of chromium by which it is understood that he means dendritic material, he is primarily interested in conducting a burnishing operation and spacing his cathode from his anode by his relatively wide spacer block.

U.S. Pat. No. 3,183,176 issued May 11, 1965 to B. A. Schwartz, Jr., discloses the electrolytic treatment or coating of a bore by use of a brush coating apparatus mounted on a drill press. The inside of the bore is acted upon by a series of centrifugally extended rotating vanes having dielectric outer covers. The speed of rotation is very great and considerably higher than usually used in brush plating. The electrolyte is distributed to the surface of the vanes through the perforated cover.

U.S. Pat. No. 3,619,383 issued Nov. 9, 1971 to S. Eisner, discloses an electrolytic coating composition in which the surface of the strip which is being passed through an electrolytic coating tank is contacted with a special "activation" means which scratches the surface of the strip to activate such surface by, it is postulated or believed by Eisner, removing the polarization layer and distorting the metallic deposit in a manner which results in an increase in the rate of electrodeposition. The activation of the surface is provided by passing in contact with the strip an open weave fabric or compressed non-woven substrate having abrasive particles on the surface which scrape and plow the surface just as the electrodeposition takes place. The fibrous nature of the activating means also tends to draw along electrolyte with it so that the surface of the cathodic workpiece is always exposed to a fresh electrolyte. It is said that the activation process "precludes dendritic growth".

U.S. Pat. No. 3,699,015 issued Oct. 17, 1972 to N. E. Wisdom, discloses an electrodeposition process including the use of small "dynamically hard particles having a vibratory motion". It is said such treatment considerably increases the throwing power of the electro-deposition process. Wisdom discloses the prior use of small glass spheres, sand and the like to beat the electrolytic material deposited upon the coating surface within a vibratory chamber and make it more dense and coherent, but indicates that his vibratory particles are superior. The vibration coats particles with the electrolytic solution and carries it apparently to the pieces being coated which are supported above the nominal solution level, but within the accumulation of particles.

U.S. Pat. No. 3,699,017 also issued Oct. 17, 1972, to S. Eisner, refers to both the prior art and the preceding Wisdom patent and discloses that he makes use of a deposit particle having a body or core portion formed of an electrically conductive material which is usually, but not necessarily, the same metal as intended to be deposited. Over such core is a protective outer covering or sheath of non-conductive material which is sufficiently hard to permit the particles to act as "dynamically hard". It is said that the particle cores, being electrically conductive, provide reasonably direct passage for the current flow and the particles themselves act as bipolar electrodes.

U.S. Pat. No. 3,734,838 issued May 22, 1973 to S. Eisner, is an improvement on his previous '383 patent in which small abrasive particles held on a fibrous or woven strand are used to remove or abrade away a "depleted ion layer". In the '383 patent, small particles of electrolyte are introduced to the plating zone in small discrete volumes. The process is said to be useful in depositing alloys as distinguished from single metal or ion coatings.

U.S. Pat. No. 3,749,652 issued July 31, 1973 to S. Eisner, discloses a further method of forming soft chromium deposits which are not as subject to cracking as hard chrome. Eisner uses in one embodiment at least, a mechanical activator disk formed of Dacron fibers and carrying a coating of 600 grit silicon carbide abrasive secured to the Dacron fibers by a polyurethane adhesive. The disk is rotated against the end of the rod during electrodeposition and is indicated to result in a superior non-cracking coating.

U.S. Pat. No. 3,751,346 issued Aug. 7, 1973 to M. P. Ellis et al., discloses an arrangement by which a combined plating and honing procedure may be followed. In the arrangement, a plurality of honing stones are arranged to be movable into contact with the surface of the workpiece during the actual plating operation resulting in better surface characteristics, superior, it is said, to what was obtained before.

U.S. Pat. No. 3,753,871 issued Aug. 23, 1973 to S. Eisner, provides a somewhat different embodiment of the Eisner vibrating activation particles to activate the surface. Hard outer layers are formed over softer inner layers in the new Eisner particles.

U.S. Pat. No. 3,769,181 issued Oct. 30, 1973 to J. L. Biora et al., discloses simultaneously machining and electroplating a workpiece by using a rotatable machining tool applied against the surface of the workpiece being electroplated at the same time as an electroplating solution under a high current density is applied to the machining zone. It is stated that high deposition speeds are possible because of the strong agitation provided by the apparatus in a very short distance or restricted area between the anode and the cathode which permits the use of ten times the current densities used in normal plating processes. The machining tool is called in some places a honing tool and it is stated that this can be used as the anode. Various increases in properties are alleged.

U.S. Pat. No. 3,772,164 issued Nov. 13, 1973 to M.P. Ellis et al., discloses the use of honing stones which hone the surface of a workpiece as an electrolytic coating is being applied.

U.S. Pat. No. 3,886,053 issued May 27, 1975 to J. M. Leland, discloses a method of electrolytic coating involving pulsing the current through an electrolyte containing a chromium plating solution while simultaneously performing a honing operation. The hydrogen derived from the coating process is allowed to escape intermittently during the reduced current period in order to avoid buildup of stress and provide a softer plated coating adjacent to the workpiece. It is disclosed by Leland that the honing of a chromium coating, for example, allows a high current density and faster deposition than the normal electrolytic tank process. The higher hardnesses, states Leland, of honed-forming processes have been attributed to the mechanical work introduced in the plating process by the honing operation. This, however, locks in residual tensile stress and adversely affects the junction between the metal base and the plating causing adhesion failures. Leland indicates that he has found that by providing an on-and-off current period by pulsing the plating current, a softer coating is provided. The mechanism as explained by Leland comprises essentially the deposition during the deposition period in chromium plating of chromium hydride (CrHx) on the base metal. During the subsequent non-deposition period, the CrHx, being thermally unstable, is afforded time to decompose and the hydrogen gas is allowed to escape before the commencement of the next deposition period.

U.S. Pat. No. 4,125,447 issued Nov. 14, 1978 to K. R. Bachert, discloses the use of a brush attached to a movable anode within a hollow member being electroplated. The brush comprises a plurality of bristles made from plastic or other insulated material which rub against the inside surface of the tube being electroplated as the anode vibrates. This, it is said, provides an agitation, scrubbing and/or washing action inside the tube which tends to remove any plating material that does not have good adhesion and results in a uniform plated surface on the tube.

U.S. Pat. No. 4,176,015 issued Nov. 27, 1979 to S. Angelini, discloses the brushing of the surface of a series of bars as they are passed in a straight line through an anode immersed within an electroplating bath. The brushing is provided by a brush comprising a blade having a layer of fiber or the like scraping material compressed between side plates. Such brush material is made of acid resistant material from which the glass fibers protrude only as much as necessary to touch the surface of the bars to be polished. It is said that the removal by the action of the brush of the cathodic film on the surface of the bars remarkably improves the plating process and the quality of the chromium layer on the bar surface. The cathodic film is formed, according to Angelini, of hydrogen ions which interfere with the plating current flow consequently hindering the electro-deposition of the chromium. As indicated, the brushing device removes such cathodic film.

U.S. Pat. No. 4,210,497 issued Jul. 1, 1980 to K. R. Loqvist et al., discloses the coating of hollow members including movement inside the cavity of such members of an electrolytic solution by means of a "conveyor" which consists of a resiliently and electrically insulating material such as perforated, net-like or fibrous strip which is wound helically around a reciprocating anode. The strip is fringed or slit on the edges facing towards the cavity wall to form fingers extending outwardly into contact with the cavity wall. It is said that the helical arrangement of the strip aids in conveying foam and gases formed during plating with high current density out of the cavity. It is also stated that in order to increase the rate at which the electrolyte, foam and gases are transported, the workpiece along with the anode and the fringe strip about it can be arranged vertically or at a suitable inclination calculated to aid the removal apparently of the gases. It is also stated that the gas conveying and electrolytic conveying material can consist of various types of perforated fibers or net-like bands other than the plastic strip mentioned and that the function of the resilient electrically insulated material is to act as a conveyor of electrolyte, foam and gases which can be supplemented by forming the anode as a screw conveyor. Furthermore, it is stated, several conveyors can be arranged in the cavity.

U.S. Pat. No. 4,595,464 issued Jun. 17, 1986 to J. E. Bacon et al., discloses the use of a so-called brush belt for continuously treating a workpiece. The brush belt is in the form of a continuous loop which passes over suitable rollers or pulleys and brings plating solution in the brush portion to the plating area. The brush is formed of a highly absorbent material which is chemically inert to the plating solution. It is stated that an open-cell urethane foam or other materials such as felt or neoprene is preferred. The absorbent material must be capable of allowing the solution to pass through one side to the other and be held by the material. It is said that the belt may be driven in a direction opposite to the workpiece at a speed that will most effectively break down the cathodic film buildup on the interface or contact point between the brush belt and the web workpiece. It is also stated that a squeegee apparatus may be placed at a location on the brush belt after it passes by the supply of plating solution to squeeze out plating solution remaining on the belt after the plating operation. Essentially, therefore, Bacon et al. provides an absorbent belt which passes in opposition to the material to be coated.

U.S. Pat. No. 4,853,099 issued Aug. 1, 1989 to G. W. Smith discloses a so-called gap coating apparatus and process in which a relatively small elongated gap is established through which coating solution is passed at a high rate. It is said that the ultra high flow rate allows very high current densities. It is stated the process is not well suited for chromium plating, because high current densities do not increase the plating out of chromium.

U.S. Pat. No. 4,931,150 issued Jun. 5, 1990 to G. W. Smith, discloses a so-called gap-type electroplating operation in which a selected area of workpieces is coated by forming an electrode closely about such so-called gap and passing electrolytic solution through the gap at a high rate. It is stated that the ultra-high volume flow assures the removal of gas bubbles, the maintenance of low temperature and high solution pressure contact with the anode surface and a workpiece surface. It is stated that gaps approaching two and one half inches can employ the invention, but the gap would preferably be smaller, but at least 0.05 inches in width. It is stated that a fresh plating solution having a controlled temperature and no staleness is available at all times in the gap for uniform plating and while in high pressure contact with the surface of the gap. In practice, the plating solution is forced in a vertically upward direction so that any gas generated by the electrolysis in the gap migrates upwardly in the same flow direction as the plating solution is being driven and, therefore, can readily escape. It is also stated that chromium is difficult to use in the invention because chromium deposits slowly regardless of current density so that the deposition is slow and the advantages of gap plating are not fully attained.

While other processes and apparatus have, therefore, been available to both to remove hydrogen bubbles from cathodic coating surface, sever and remove dendritic material in coating processes such as the electrolytic coating of chromium and prevent depletion of the electrolytic solution, all such prior processes have had drawbacks and none has been effective to accomplish all three or even two of the disclosed aims by themselves.

OBJECTS OF THE INVENTION

It is an object of the invention, therefore, to provide an apparatus which wipes the surface of a cathodic workpiece to remove hydrogen bubbles.

It is a further object of the invention to wipe the surface of a cathodic workpiece with a solid contact blade wiper to remove hydrogen bubbles from such surface.

It is a further object of the invention to provide a solid wiper with an extended contact surface resiliently biased against the surface of a cathodic workpiece to detach bubbles of hydrogen and to encourage coalescence of a cathodic film into bubbles so that such bubbles can be removed on a subsequent pass.

It is a still further object of the invention to provide a substantially solid wiper blade biased against a cathodic work surface in a manner such that the solid wiper blade blocks forward movement of the electrolyte along the surface of the workpiece forcing used solution away from the surface and causing fresh solution to flow in behind the wiping blade thus effectively forcing exchange of coating solution to prevent depletion of such solution.

It is a still further object of the invention to provide a substantially solid wiping blade having a restricted cross section and resilient so that the blade when biased against a cathodic coating surface in a flexed configuration bears against the surface and both dislodges hydrogen bubbles from such surface and blocks the passage of electrolytic solution past such resilient blade.

It is a still further object of the invention to provide a substantially solid wiper having an extended contact blade biased against a cathodic work surface by resilient means which either biases the wiper blade in its own plane toward the coating surface or pivotably toward the coating surface.

It is a still further object of the invention to combine a substantially solid wiper blade with a perforated anode adjacent the cathodic work surface to maximize the efficiency of interchange of electrolyte by the wiper blades.

It is a still further object of the invention to provide a substantially solid plastic wiper blade for wiping a cathodic coating surface during coating which wiper blade incorporates fine abrasive material at least in the end to abrade the coating surface as it is being formed.

Additional objects and advantages of the invention will become evident from review of the following description and explanation in conjunction with the appended drawings.

BRIEF DESCRIPTION OF THE INVENTION

It has been discovered that a very effective acceleration of electrolytic coating plus the production of considerably better quality coatings can be attained by the use of a wiper blade having a substantially solid wiping edge portion which is resiliently biased against the cathodic coating surface. The blade itself may be resilient or it may be biased against the coating surface by associated resilient means while the cathodic coating surface moves relative to such wiping blade and also a closely spaced anode. Preferably the wiping blade is mounted upon the anode or even made a portion of the anode structure, but it may have an alternative means for mounting. The wiper blade effectively removes bubbles of hydrogen from the cathodic work surface and in those cases where dendritic material extends from the surface during the establishment of the coating, effectively severs such dendritic material and allows it to be removed from the coating vicinity. Dendritic material may extend from the coating during deposition, for example, in the production of chromium electroplated coatings and the like. The solid wiper blades also effectively block the passage of a surface layer or film of electrolyte next to the cathodic plating surface when such surface and a surface film of electrolyte are moving together relative to the main body of electrolyte and causes replacement of such surface film with new electrolyte, thus preventing depletion of the surface layer of electrolyte. In a preferred arrangement, the wiping blade is combined with a perforated anode which allows ready escape of the depleted electrolyte layer and replacement with fresh electrolyte. The wiper blades may be provided with an included abrasive material to smooth the surface of the coating as plating proceeds.

BRIEF DESCRIPTION OF THE DRAWING

FIG. 1 is a transverse cross sectional view of an arrangement for practice of the invention.

FIG. 2 is a side view of one embodiment of the wiper blades shown in FIG. 1.

FIG. 1A is a transverse cross section of an alternative embodiment of a portion of an apparatus for practicing the invention.

FIG. 21 is a diagrammatic end view of an alternative embodiment of the invention involving the use of a sectionalized anode with resilient wiper blades mounted between the sections.

FIG. 22 is a side view of one of the wiper blades shown in FIG. 21 mounted in a sectionalized anode.

FIG. 23 is a side view of an alternative slotted wiper blade.

FIG. 24 is a diagrammatic side view of a series of resilient wiper blades mounted in a sectionalized anode for use in continuous electrolytic coating of a sheet or strip.

FIG. 25 is a plan view of the top of the sectionalized anode and resilient wiper blade arrangement shown in FIG. 24.

FIG. 26 is a section through a wiper blade such as shown in FIGS. 21 through 25 showing an additional fine abrasive material included in the end of the wiper blade.

DESCRIPTION OF THE PREFERRED EMBODIMENTS

Figure 3:
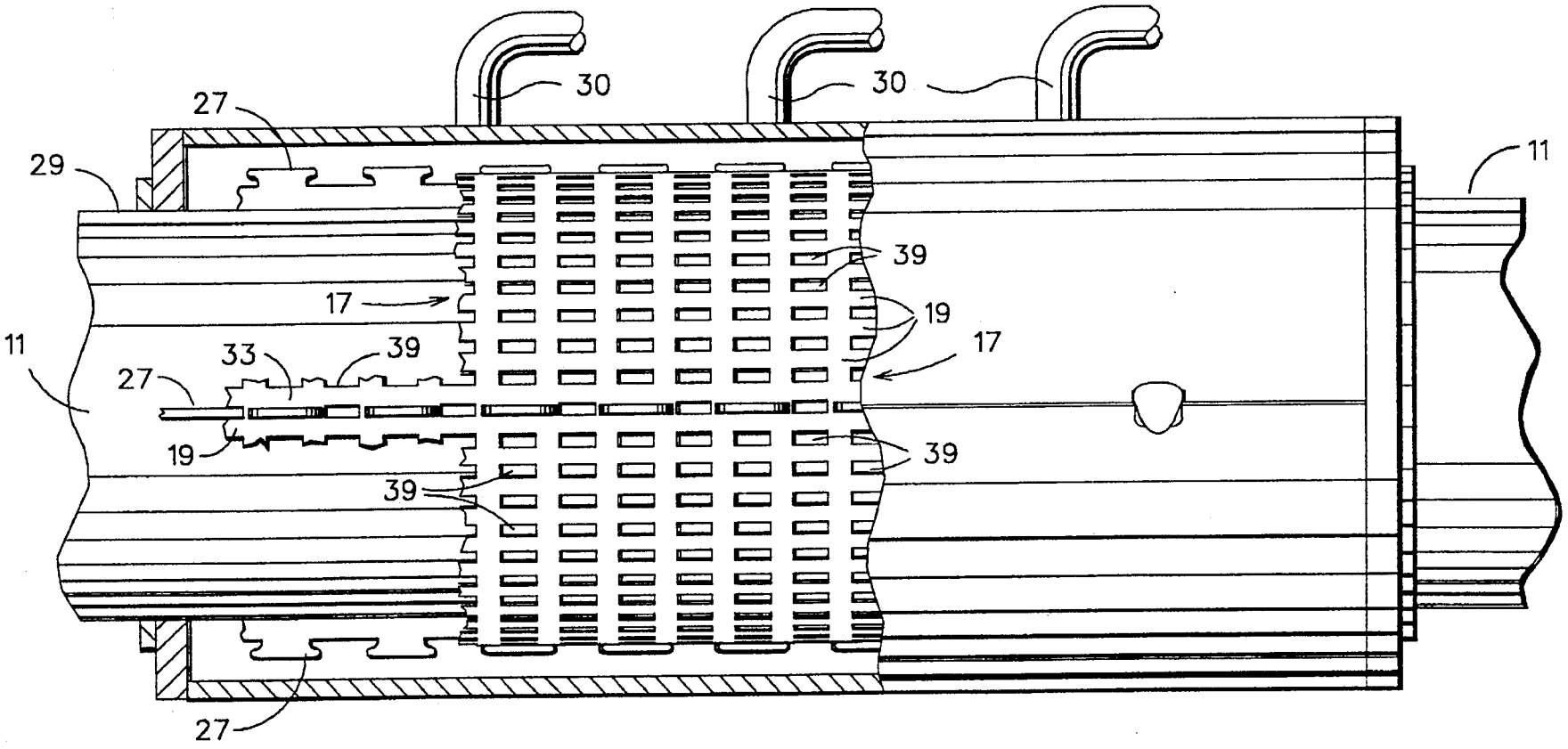
FIG. 3 is a partially broken-away side elevation of a preferred arrangement for practice of the invention shown in FIG. 1.

Various ways of removing hydrogen bubbles from the surface of a cathodic workpiece in an electrolytic coating bath or operation have been developed in the past which have in aggregate been effective to a certain limited extent, but which have left room for improvement. Likewise, various expedients to prevent electrolyte solution depletion have been developed to make sure that electrolytic coating solutions remain continuously fresh and ready to be plated from at their design composition. Most of such systems or developments have depended upon frequent changes of the electrolyte, forced circulation by pumps and the like during coating and frequent or continuous analysis of the electrolyte.

The present Applicants have discovered through careful experimental development that such previous systems can be considerably improved and, in fact, superseded, at least in those cases where there is a substantial extent of either round or flat cathodic workpiece surface to be electrolytically coated, by the use of a novel, basically solid wiping blade section having an extended wiping blade surface which resiliently contacts the coating surface and lightly wipes such surface along a relatively narrow line of contact. The arrangement is not unlike that of a wind shield wiper on a car in which either, as is most usual in the majority of coating operations, the cathodic work surface moves past a stationary wiper blade, or alternatively, where a wiper blade is moved past a stationary work surface, or both. The wiping blade is usually and preferably attached to or mounted upon an anode construction closely spaced to the cathodic work surface. The wiper blade, as it passes over the coating surface, is resiliently urged toward and against the work surface at one end or side where it dislodges hydrogen bubbles which have collected upon such surface. It also causes small hydrogen bubbles to coalesce into larger bubbles which are more easily removed or brushed off by the wiper blade or by their own buoyancy spontaneously detached from the coating surface. It is also believed that the passage of the wiping blade causes the so-called cathodic layer or film, which is, it is believed, composed of a thin film of a mixture of uncoalesced hydrogen atoms and hydrogen or hydronium ions, to be partially dislodged and caused to also coalesce into small bubbles of hydrogen, whereupon such small bubbles further coalesce under the influence of the wiping blade either upon the same passage or a subsequent passage of the wiper blade and are ultimately also displaced by the wiper blade. In those coating processes, furthermore, where the coating tends to send out or develop dendritic tendrils or processes from its surface, the wiping blades very effectively sever such dendritic material which, if not removed, has a preferential tendency to rapidly elongate or grow because it is closer to the anode and thus causes uneven coatings.

The wiper blade also, it has been discovered, very effectively causes rapid change of electrolytic coating solution next to the coating surface and, therefore, prevents depletion of the electrolyte which interferes with efficient and rapid coating and, in fact, may in many cases, cause not only uneven coating, but also otherwise defective coatings. As a workpiece passes through a coating tank or other solution container, it tends to carry along with it a thin layer of electrolyte which is separated from other electrolyte in the tank by a more or less definite boundary, which, while usually more or less turbulent, may transfer electrolyte across the boundary rather slowly. Since the plating out of the electrolytic coating takes place more or less exclusively from the thin layer adjacent the cathodic work surface and such layer is partially isolated or separated from the remainder of the electrolyte, by the boundary established between the moving surface layer and the static main body of electrolyte, such thin layer rapidly becomes partially depleted of coating metal, inherently causing slower plating as well as other difficulties. A continuous coating operation, in fact, may establish an equilibrium in which actual plating is continuously being made from a partially depleted layer of electrolyte in which the concentration of coating metal is significantly less than in the rest of the electrolytic coating bath and not at all what analysis of the bath may indicate. It has been found that the wiper blades of the invention effectively cure this local depletion phenomenon and cause a substantially complete replacement of electrolytic solution next to the coating surface every time it passes a wiper blade. In this way, what may be referred to as the depletion layer is periodically and rapidly, depending upon the spacing of the wiper blades and the speed of the underlying cathodic coating surface, completely changed or replaced so that over a period, substantial differences between the analysis of the depletion layer and the analysis of the electrolytic coating bath as a whole does not develop resulting in a considerable increase in coating efficiency.

As the resiliently biased wiping blade passes over the cathodic coating surface, it flexes upwardly or outwardly so that it rides easily over the increasing coating weight or thickness of coating if there is a recirculation of the coating surface under the same blade as, for example, where a round cathodic coating member such as a shaft, journal, roll surface or the like is being coated.

In a preferred arrangement of the coating blade, it may be attached to or closely spaced to a significantly locally discontinuous anode, such as an anode with fairly large or many small openings in it, a grid-type anode or other discontinuous anode which allows coating solution to flow through the anode both away from the front of the blade as the surface depletion layer approaches the wiping blade and back behind the blade as such blade passes by. In this way, the solution is always being periodically changed. The wiping blade construction of the invention has been found particularly effective in the deposition of chrome from electrolytic solutions, but may also be used in the electroplating of tin coatings, particularly for tin plate or so-called decorative metal coatings such as, in addition to chrome, nickel, cadmium, nickel and copper. Some potentially electroplated coatings such as zinc and the like can usually be more cheaply coated by so-called hot dip coating processes.

FIG. 1 is a cross section of an apparatus for practicing the present invention to attain a hard chrome coating on a cathodic workpiece. In FIG. 1, a shaft 11, having a surface or a portion of a surface to be electrolytically hard chromium coated is mounted within an outer plastic shell or housing 13 which is shown as having an upper half **13*a* and a lower half, 13*b*, connected by an appropriate hinge and clasp arrangement 14*a* and 14*b*, the details of which are not specifically illustrated. Such outer plastic shell 13 surrounds a substantially open electrolytic solution space 15 which extends between the shell 13 and the surface 29 of the shaft 11 to be coated. Within the electrolytic solution space 15 is mounted a grid-type electrode 17 comprised of longitudinal grid members 19 and transverse grid members 21. It will be seen that the longitudinal grid members 19 have been bisected in the cross sectional view of FIG. 1, while the transverse grid members 21 can be seen beyond the bisection plane. Such grid-type electrode may be formed by an appropriate casting operation in the form shown more particularly in FIG. 3**. Usually the grid-type electrode will be cast initially in a flat mold and will then be bent to the necessary curvature to closely surround the coating piece to be plated. It may also be cast in partially curved or arcuate sections, however. The exact method of forming the grid electrode does not form a part of this invention.

The grid 17 is attached to bus bars 23 as shown in FIG. 1 through the intermediate electrode surface 25 and may also, if necessary, be supported at other places by insulated brackets, not shown. Mounted upon the electrode grid 17 at spaced points are so-called wiper blades 27, which are preferably mounted dependent from the anode and bear against the surface 29 of the shaft 11. The wiper blades 27 are formed of a flexible or resilient plastic material resistant to degradation by chromium acid solutions and arranged to bear upon the surface 29 of the roll 11 preferably on the side of one end of the plastic wiper blade. The top of the plastic wiper blade 27 is preferably fixed in the grid of the electrode 17 by essentially a snap action provided by pressing interconnecting snap sections 31 into appropriate orifices in the grid of the electrode 17 so that the upper portion of the wiper blade 27 is oriented towards the shaft 11, but is then deviated to the side by contact with the surface 29 of the shaft 11. The amount of pressure exerted upon the surface of the shaft as it rotates in contact with the end of the wiper blade, which is bent in the same direction as the rotation, is therefore related to the thickness of the wiper blade in the section of such blade extending from the surface 29 of the shaft 11 to the grid-type electrode 17. The preferable wiper blade thickness will be about 1/16 to 1/8 inch in thickness and the distance of the cathode surface from the electrode grid, as indicated above, may be between 1/8 and 1/2 inch or up possibly to 1 inch, but preferably within the range of about 1/8 to 3/8 inch and preferably about 1/4 inch. Consequently, the length or height of the wiper blade should be approximately 1/2 inch to 1.5 inches or thereabouts, depending upon the support arrangement, or in those cases where the spacing between the cathodic coating surface and the anode surface is greater than 1/2 inch, may be correspondingly greater. The normal bearing of the wiper blade upon or against the surface of the roll will, therefore, be rather light and insufficient to burnish or polish the surface, but sufficient to detach any dendritic material extending upwardly into the bath from the cathodic work surface and to cause evolution of hydrogen bubbles from the surface. It appears that the evolution of the bubbles involves more than mere detachment of bubbles already formed, but also involves a coalescence of very small or minute hydrogen bubbles upon the surface as well as in the form of a thin cathodic film, first into very minute bubbles and then rapidly, under the influence of the repeated contact with the wiper blades as the shaft revolves, into larger bubbles which are displaced from the surface of the roll and rise through the liquid. Such bubbles collect in the upper portion of the plastic housing 13 and may be discharged through hydrogen collection, or takeoff, pipes 30 at the very top of the casing 13.

Since the wiper blades are very thin and only the side of the end of the blade contacts the surface, only a minimum contact of the blade with the surface is involved so that a minimum interference with actual coating upon the surface occurs. Furthermore, since the wiper blades are very thin, in any event, and are made from a dielectric material, such blades have a very minimum interference with the electrical field between the anode and the cathodic work surface and thus minimum interference with the throwing power of the electric field during the coating operation.

Preferably the top of the coating blades shown in FIG. 1 are made, or formed, as shown more particularly in FIG. 2. It will be seen in FIG. 2 that the upper portion of the wiper blade is formed into a series of expansion-lock or snap sections 31 having outwardly expanded tops 33, which may be jam-fitted into the openings between the longitudinal and transverse sections 19 and 21 of the grid-type anode 17. This construction allows the wiper blades to be quickly interlocked with the anode grid and to be simply and easily removed when the wiper blades 27 become worn and need to be replaced by new wiper blades. Normally the wiper blade 27 will be made by stamping out a series of the blades with the expanded top sections already formed upon them. However, it will be understood that various sections or shapes of the portion of the wiper blade which holds such blade in place may be formed depending upon how it is desired to attach the wiper blade to either the electrode, i.e. the anode, or to some other portion of the apparatus. FIGS. 9 through 15 discussed hereinafter show one very effective alternative arrangement for fastening, and FIGS. 21 through 25 shown a very desirable alternative.

In FIG. 1, two electrolyte inlets 37 are positioned near the bottom of the coating chamber structure for passing fresh electrolytic solution continuously into the electrolytic chamber 15. Likewise, two outlets 39 are shown at the top where the electrolytic solution can flow from the electrolytic coating solution chamber 15. The outlets 39 are located near the top of the coating chamber, but displaced therefrom somewhat in order to leave the top portion free for hydrogen outlets 30. It has been found advisable to inlet the solution near the bottom of the electrode chamber and to remove the used solution from the top so that the chamber will always be completely filled. Consequently, it is desirable to have the outlets as near the top as possible. However, it is also desirable to have the gas outlets at the top in order to obtain as pure gas, or hydrogen, as possible and to have the electrolyte outlets spaced a reasonable distance to the side of the gas outlets. Since the gas outlet is provided with a more elevated or longer straight section **30*a* than the straight elevated section 39*a* of the electrolyte takeoffs, a maximum level of liquid tends to be established in the straight section 30*a* allowing gas to be discharged beyond that through the takeoff 30. As a practical matter, however, it will be found that there is considerable carry-over of liquid electrolyte in the gas takeoff 30 and considerable gas being carried over into the electrolyte takeoffs 39**.

An improved arrangement for taking off both gas and liquid electrolyte is shown in partial section in FIG. 1A in which a separation chamber or compartment 41 is provided along the top of the horizontal casing 13, shown in FIG. 1. From the top of the compartment 41 extends the gas takeoff 30 and from the sides extend slightly downwardly inclined electrolyte take off or drain pipes 43 which connect with horizontal collection manifolds 45, which are, in turn, connected with piping, not shown, leading to a make up and/or storage tank for electrolytic solution from which fresh or reconstituted electrolyte is conducted back via the feed lines 37 to the electrolytic coating chamber 15. The capacity of the manifolds 45 should be sufficient to carry away any reasonable amount of solution fed to them, so that a substantially free flow condition away from the top of the coating chamber is established. The off takes 43 establish a liquid level 47 within the separation compartment 41 leaving an open space 42 in the upper section in which gas bubbles may separate from the electrolytic liquid and then leave upwardly through gas takeoff 30 with only relatively little carry over of fine spray derived from bursting bubbles at the surface 47 of the liquid. Meanwhile, the downward slope of the liquid takeoffs 43 discourages gas from leaving with the escaping liquid, except in the form of very small entrained bubbles of hydrogen. It has been found, however, that the wiper blades 27 originally tend by their passage to coalesce such very small bubbles into relatively larger bubbles which are fairly easily separated from the liquid in the separation chamber 41. Other comparable or, alternatively, more sophisticated separation arrangements may be used. The evolution of hydrogen tends to be so copious with the use of the wiper blades of the invention that the gas lines 30 may be conducted to apparatus for treating such gas by drying and other purification steps, if desired, to make it suitable for use as a relatively low grade fuel gas for less critical uses such as local plant use and the like.

FIG. 3 is a partially broken-away side elevation of the coating arrangement shown in FIG. 1. In FIG. 3, it may be seen that there are several of the hydrogen-removal passages 30 disposed along the top. It has been found that the evolution of hydrogen from the action of the wiper blades 27 is extremely vigorous with a very large evolution of gas. Consequently, it is desirable to have adequate exhaust capacity for removal of such hydrogen, not only to prevent internal pressure from building up in the coating apparatus, but to eliminate the gas so it cannot occlude the cathodic work surface. It is believed, furthermore, that the thorough removal of hydrogen in bulk from contact with the electrolytic solution minimizes retention of a cathodic film on the cathodic coating surface.

It may be seen in FIG. 3 that the electrode grid is arranged essentially in line with the shaft surface. The electrode grid is shown partially broken away to the left to reveal the wiping blades 27 as well as the top expanded interlock portions 31 of the wiping blades 27 which essentially fit, as seen, into the openings 49 between the grid pieces 19 and 21. In FIG. 3, the outer plastic sheath or shell 13 of the coating chamber is shown towards the right, but broken away in the center to reveal the electrode grid 17 thereunder. It will be noted in both FIGS. 1 and 3 that the wiper blades 27 are spaced essentially at 90 degree intervals about the shaft 11. This has been found to be about right where the shaft rotates during coating at a fairly rapid velocity. However, in some cases, the four blades might be spaced in pairs rather close together, so that the first blade wipes away or dislodges large bubbles and tends to coalesce smaller bubbles into larger, which are then immediately wiped away or dislodged by the second closely following blade. In such case, however, there will be at least one other set of wiper blades, either single or double spaced in a circumferential position at about right angles to the other pairs of wiper blades. This is desirable because the dielectric wiper blades serve not only to wipe hydrogen bubbles from the coating surface and to interrupt passage of a surface layer of electrolyte about the workpiece, but also to aid in centering the workpiece in the anode to prevent the surface of the anode and the surface of the workpiece from too close approach and arcing with consequent damage to both the workpiece and the anode.

The wiper blades should be spaced so that bubbles of hydrogen, in particular, are wiped from the surface before any significant deposit or collection has been allowed to form. Consequently, the spacing of the wiper blades will be dependent to some extent, upon the speed of the shaft and the rate of coating deposition, since a higher rate of coating, occasioned by a high current density between the electrodes will also normally form more hydrogen by electrolysis of the coating solution. Consequently, if the revolution of the shaft is set to be rather slow, more wiper blades may be desirably spaced about the shaft. Likewise, if the shaft section is fairly small and rapidly rotating, less than the number of blades shown in the FIGS. 1 and 3 may be used. For example, for a small rapidly rotating shaft, it may be found that as few as three wiper blades may be adequate, or if there is no substantial danger of the anode and cathodic workpiece coming in contact or within arcing distance of each other a single wiper blade on each side of the shaft may be quite adequate or even, in the case of very small rapidly moving workpieces, even a single wiping blade. For larger shafts, however, more frequent placement of the blades than the usual minimum desirable of three or four circumferentially about the rotating shaft or other cathodic workpiece may be preferable.

Since it is frequently difficult to form an adequate seal about the surface of the member being coated, where it is necessary for such member to extend from the coating chamber or where a rotating shaft or other movement engendering means must extend through the wall of the coating chamber to cause movement of the cathodic work surface, or, alternatively, movement of the anode about the cathodic work surface, difficulty in effectively sealing the electrolytic solution within the coating chamber may be encountered. It has been found preferable, therefore, in those instances where applicable, to use an apparatus such as shown in FIG. 4 where the coating is accomplished within a vertical tank having effectively closed sides and bottom, but open on the top where the material to be coated can be passed into the tank within the circumferential or other suitable dimensions of a grid-type electrode, preferably as shown, by any suitable hoisting means, and then rotated within the anode to effect electrolytic coating of the cathodic surface of the workpiece.

Figure 4:
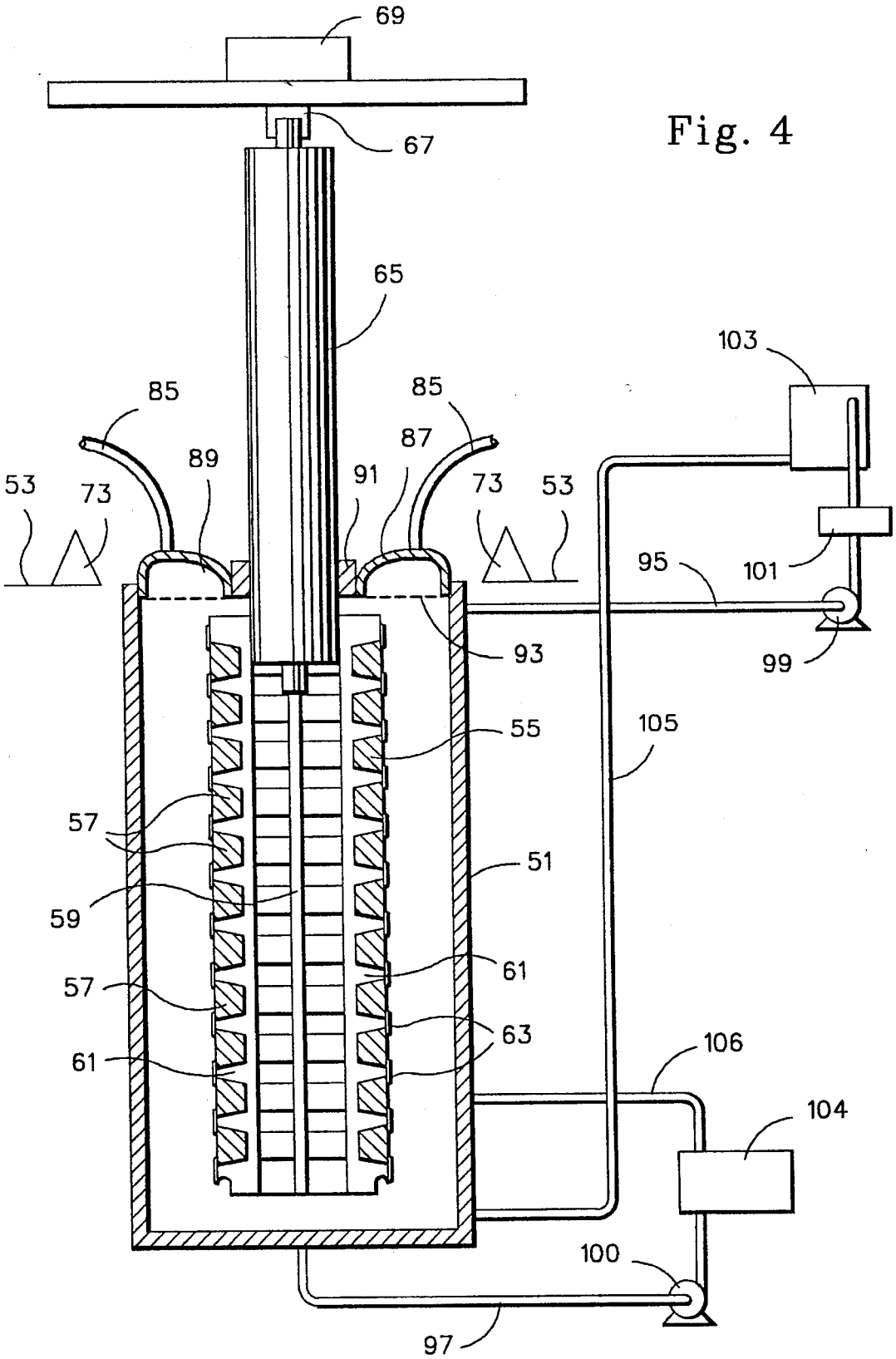
FIG. 4 is a diagrammatic side view of one preferred arrangement of the invention for coating cylindrical workpieces involving the use of a vertical containment tank.

In FIG. 4, an in-ground tank 51 is shown sunk below the surface 53 of the ground or the floor of a shop. The tank may be in a pit and will preferably be surrounded with at least one additional safety tank, not shown. A grid-type electrode 55 is suspended in the tank 51 by any suitable support means, not shown. The grid-type anode 55 is shown in cross section so that only the horizontal members 57 of the grid-type electrode 53 are shown in section. However, both horizontal members 57 and vertical members 59 are shown in the background between the edges of two wiper blades 61, which extend vertically along the grid and are locked into the grid by the expanded locking sections 63.

A roll or shaft 65 is shown supported by a grip or chuck 67 of a crane arrangement, not shown, and the roll or shaft 65 may be rotated by a rotational mechanism 69 mechanically attached to the chuck 67. During operation of the coating process of the invention, the shaft 65 will be supported by the chuck 67 which is attached to a beam 71. This beam 71 can, as shown diagrammatically, be supported during coating upon the beam supports 73 on the shop floor and the shaft 65 rotated, by means of the rotating mechanism 79, within the grid-type anode 55 with the wiper blades 61 bearing lightly upon the surface of the shaft 65 to both remove bubbles of hydrogen and also sever and remove outwardly growing dendritic material extending from the coating surface. Such dendritic material will become a problem, which is neatly eliminated by the wiper blade of the invention, in certain electrolytic coating processes such as the electrolytic coating of chromium and the like on a cathodic work surface, for which the use of the wiper blade of the invention has been found to be particularly applicable, although such wiper blades are clearly applicable to the electrolytic coating of other metals as well.

Since the tank 51 will be maintained completely full of electrolytic solution, the bubbles of hydrogen will rise, due to their minimum specific gravity, to the top of the tank 51 and may be removed through the outlets, or off takes 85, which, as may be seen in FIG. 4, are attached to the highest portions of the top 89, which portions, for convenience, are provided on the outside to form an internal collection ring or zone 87 within the closed top 89 of the tank 51. Any suitable seal 91 may be provided between the closed top 89 of the tank 51 and the side of the round chuck 67, as shown more particularly in FIG. 5 described hereinafter. The seal 91 does not need to be extremely tight, since some escape of hydrogen through such seal is not critical and moisture in the gas does not tend to pass thorough the seals, since there is no head of liquid intruding or forcing itself against the seal, although considerable gas pressure may be generated within the foaming electrolyte if the gas is not drawn quickly away. It will be understood that the liquid in the tank 51 will be established below the very top 89 of the tank where the gas off takes 85 are located. The top surface 93 of the liquid is established by solution off-takes 95 which allow electrolytic solution to pass from the in-ground tank 51 if it becomes over full, to a pump 99 from whence it passes to a filter 101 to remove small dendritic particles or other solution debris and then to a mix or holding tank 103. A third off-take 97 may be provided in the bottom of the tank 51 to continuously remove electrolytic solution from the tank and pass it via line 97 to a pump 100, which forces the solution through a filter device 104, shown diagrammatically, and then returns the electrolytic solution to the tank 51 via a feed line 106 near the bottom of the tank 51.

It will be understood that the reservoir or make up tank 103, to which pump 99 feeds used electrolyte via filter 101, is shown diagrammatically only and may be considerably larger than shown and that various makeup arrangements and the like as well as testing facilities for maintaining the solution strength at a predetermined level will normally be involved in conjunction with the reservoir 103.

The electrolytic solution removed from the bottom of the coating tank 51 through the line 97 will normally tend to contain the majority of small solid pieces of the heavier dendritic material and the like from the cathodic coating surface which have been broken off by the action of the wiping blades 61 and such small particles of dendritic material will be removed from the solution as it is forced through the filter apparatus 104. However, some of such solid material will also be removed by the filter 101 at the top of the tank so that clean solution without solids is returned via the feed line 105 to the tank. The filter take off line 97 and associated filter 104 and the like may not be necessary in a majority of installations, where circulation within the tank may carry such material to the top of the tank for removal in the filter 101, but the additional filter takeoff line 97 is preferred to be used as a precaution.

Figure 5:
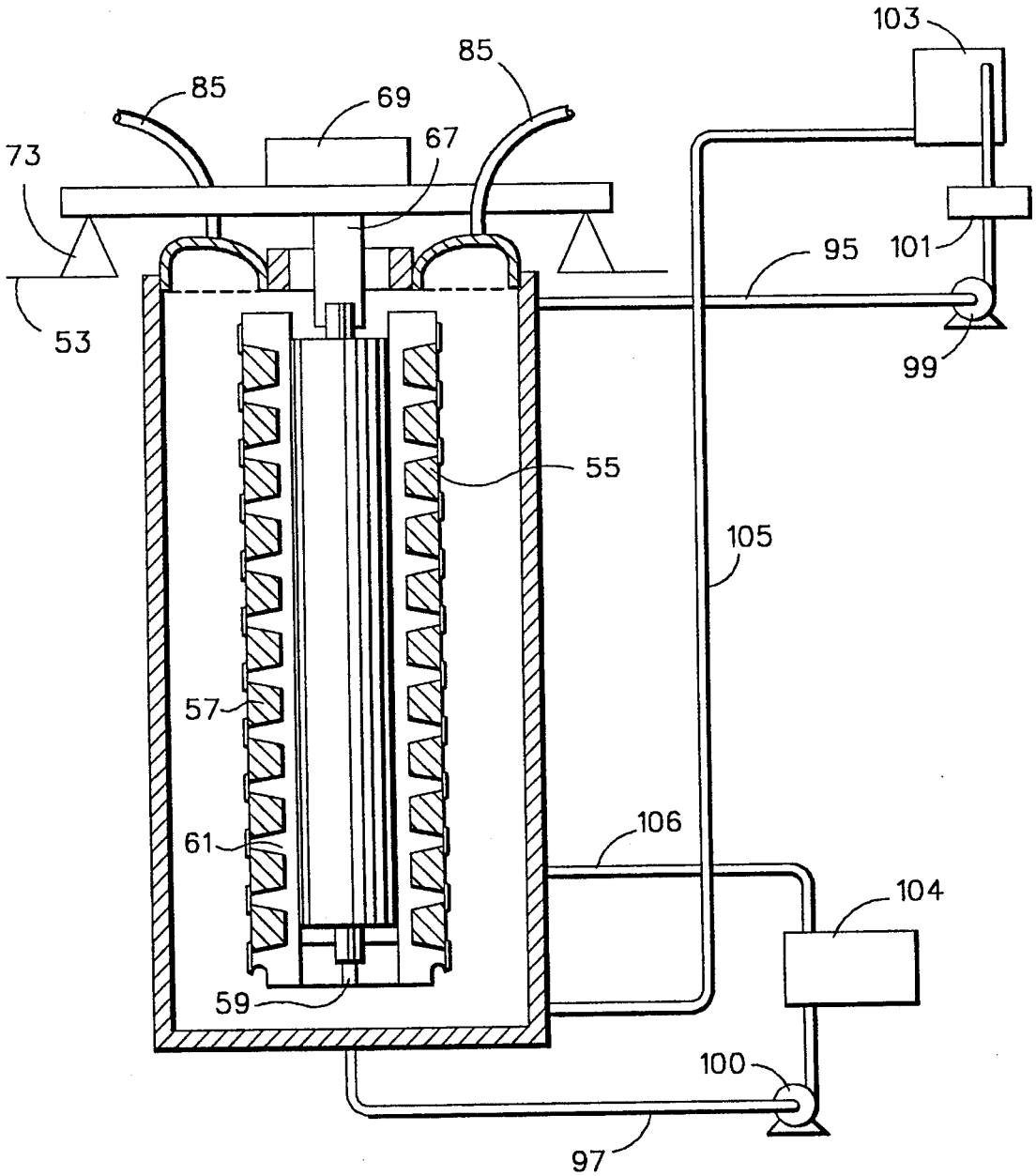
FIG. 5 is a diagrammatic side view similar to FIG. 4 showing the cathodic workpiece in coating position.

FIG. 5 is a diagrammatic view of the coating arrangement shown in loading position in FIG. 4 with the shaft to be coated lowered partially into the coating tank, now fully lowered into coating position in the center of the grid-type electrode 55. It has been found that the arrangement of the coating apparatus shown in FIGS. 4 and 5 is extremely convenient and effective when used for coating round workpieces. Such arrangement eliminates one of the prime sources of difficulty in brush coating or modified brush coating, or as illustrated in FIGS. 1 and 3, namely, to contain the solution confined at rotating seals. In general, if a seal is made tight enough to prevent leakage through such seal, it may bind the moving member and prevent it from turning, or at least turning easily, while, if the seal is backed off with a lesser pressure to allow convenient rotation of the moving part, the effectiveness of the seal in preventing the passage of the liquid, and particularly an aggressive chromic acid electrolytic liquid is essentially largely lost. The vertical tank plating arrangement shown in FIGS. 4 and 5 eliminates this problem and is especially effective with the use of the wiper blades of the invention.

It will be seen in FIG. 5 that the length of the anode assembly may not be the same as the length of the workpiece. Thus, while it is highly desirable in order to provide an effective hard chromized coating, for example, upon a workpiece, to have the anode extend effectively at all times substantially completely about the portion of the workpiece to be coated, it does no harm if the electrode extends beyond such area to be coated and, in fact, in many cases, the electrode will necessarily extend beyond the area being coated and such area of the workpiece which is not to be coated will be protected by masking tape and the like. In the same way the portion of the anode extending beyond the workpiece should be masked with coating masking tape to prevent interference with the coating operation which may sometimes develop defects near the excess extension of the anode apparently due to current anomalies in the vicinity as a result of the charged anode having no counterpart cathodic work surface. It is also desirable to provide a bearing block of some form in the bottom of the tank 51, to steady the lower end of the shaft. Any suitable constraining arrangement, not shown, can be used.

Figure 6:
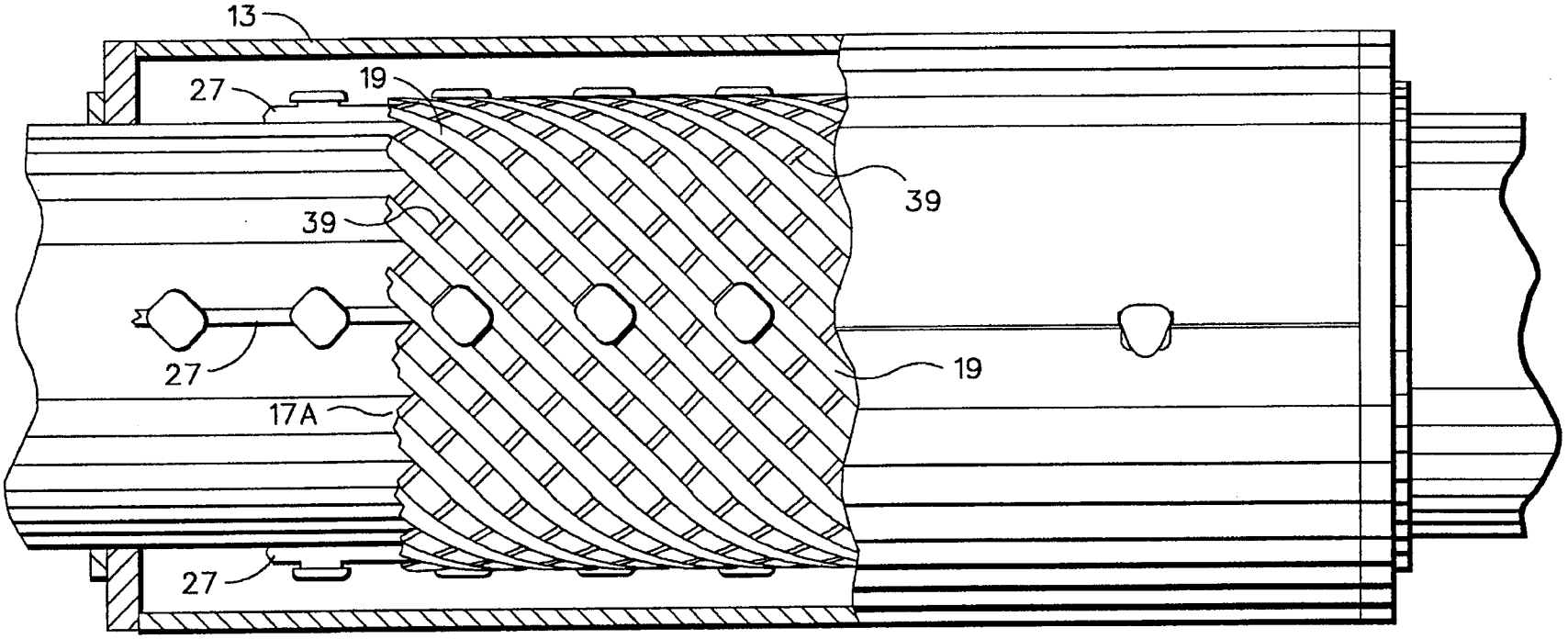
FIG. 6 is a partially broken-away side view similar to that shown in FIG. 3 showing the use of a more preferred transverse grid-type electrode used with the wiper blades of the invention.

FIG. 6 is a partially broken away view of a coating chamber arrangement similar to that shown in FIG. 3, except that the orientation of the grid-type electrode has been changed so that instead of such electrode **17*a* being orientated generally in the direction of the shaft being coated in the chamber itself, it is oriented at an angle to such shaft and chamber. This ensures a continuously changing coating pattern as the cathodic workpiece rotates within the grid-type electrode. It has been found when using grid-type electrodes such as shown in FIGS. 1 and 3, for example, that certain parts of the cathodic workpiece being coated tend to remain under portions of the grid for greater periods than other sections, and this may tend not only to attain differential coating thicknesses, possibly requiring additional grinding between passes in the case, for example, of providing heavy chromium coatings or the like, but if the rotation or movement of the cathodic workpiece is slow enough, may even tend to cause any such hard chrome deposition to cease plating. Normally, however, the speed of passage of the workpiece, or the workpiece surface, under the solid portions of the grid is sufficiently rapid so that the passage from one portion of the grid to another is sufficiently connected in time so that the deposition of hard chrome will not cease. However, different average times next to different portions of a longitudinal grid still may cause differential thicknesses of chrome to be built up on those sections of the workpiece which end up, on the average, under or directly opposite to a portion of the electrode grid for longer periods. By angling the grid, the opportunity of the work surface to remain under an actual grid member will, on the average, be evened out between all parts of the surface. Of course, some angles will be found more efficient than other angles. For example, if the angle selected is 45 degrees, there may again be a tendency for certain portions of the cathodic work surface to, on the average, remain under an actual portion of the grid for longer average periods in the aggregate. However, if an exemplary angle between 45 degrees and 90 degrees is selected to provide the maximum similarity and average times of coverage by the electrode sections of any given series of adjacent portions of the work surface, a smooth uniform coating will be attained. The angle should also be arranged so that the jam-type interconnecting portions 31 of the wiper blades 27 can be conveniently forced into an opening between the grid members of the electrode. If a regular sequence of openings which will both hold the jam fittings of the wiper blade and also cause a random coating pattern with respect to any given time that the workpiece spins under any given portion of the coating electrode grid cannot be worked out, an alternative support for the wiper blades can be devised. It is possible, for example, for some of the jam-type interconnections to be removed where they may abut closed portions of the electrode grid rather than open portions, since it has been found that the jam-type interconnections are sufficiently strong so that a maximum number of interconnections between the wiper blade and the grid-type electrode through such jam-time interconnections is not usually necessary. Rather than angling a regular grid-type electrode, as shown in FIG. 6, the electrode itself can be made with random elements, particularly if combined with angling so that there will be no regular pattern of passage of the electrode surface past the rapidly rotating cathodic workpiece surface. Various other arrangements for supporting the wiping blade may also be provided. In FIG. 6, the jam connection portions 33***a* at the top of the wiper blade are in the form of actual spread out buttons or mushroom sections.

The substantially solid wiper blade of the invention may also be used very effectively with the electrolytic coating of continuous elongated cathodic workpieces such as, for example, so-called continuous strip and sheet wherein the metal substrate is passed through an electrolytic coating bath containing an electrolyte containing dissolved ions of the metal to be plated out on the substrate. Large tonnages are produced, for example, of tin and chromium coated steel sheet and strip referred to respectively as tin plate and tin free steel or TFS, which has a very thin coating of electrolytically applied chromium applied to its surface. These coatings normally have a mirror-bright finish and are made in either a straight pass through very long plating tanks or in a multiple vertical pass line over guide rolls within a plating line.

Normally, the cathodic workpiece and the anode are maintained a fair distance apart in these lines depending upon the support of the strip to prevent touching or very close approach of the cathodic workpiece to the anode, which close approach may cause arcing with serious consequences not only to the strip, but also the the anode. The longer an unsupported length of strip is passed by the anode, the greater chance for substantial deviation of the strip from its pass line and possible impingement upon the anode. A multiple vertical pass line arrangement over support rolls in the coating bath offers more support usually as well as additional pass line compressed into a coating tank of any given length and has been frequently used on this account. However, even a multiple vertical pass line arrangement is subject to possible swaying or vibration of the strip passing between the guide rolls and the distance of the strip from the cathodic work surface is thus seldom maintained less than about one to one and a half inches from the anodes on both sides, although specialized installations having a closer gap have been used. The present inventors have found that by the use of their dielectric material wiping blade, they are able to not only efficiently wipe hydrogen bubbles from the cathodic coating surface as well as effectively sever dendritic material extending from the surface in the case of a thicker coating, and also very effectively wipe any surface layer of partially depleted coating solution from the coating surface, thus effectively preventing depletion of the coating solution next to the cathodic coating surface, but in addition by the use of their wiping blades, are enabled to steady or guide the strip, traveling past the anode and thus prevent too close an approach and arcing between the anode and the strip.

FIG. 7 is a diagrammatic side elevation of a so-called tin-free steel, or "TFS" line for coating blackplate with a thin, almost flash coating of chromium. Grounding and guide rolls 121 convey a strip 123 of blackplate, i.e. uncoated steel strip or sheet material, straight through a tank, not shown, in which the coating operation is confined in a body of electrolyte between pairs of anodes 125 formed in a grid configuration with longitudinal elements 127 and transverse elements 129 shown in section. As shown, the individual members or elements of the grid-type electrode have a truncated triangular shape slanted toward the strip surface and providing additional surface area to increase the surface area exposed to the electrolytic solution particularly in the direction of the workpiece or strip surface. The top anodes 125A and bottom anodes 125B are spaced within about one half to three quarters of an inch of each other with the strip 123 passing between them. Alternating transverse elements of the anodes are provided with resilient plastic wiper blades 131 which are attached to or mounted upon such transverse elements as shown, by essentially threaded plastic fittings, but could be mounted in the openings of the grid equally well, as shown in FIGS. 1, 2 and 3 for wiper blades used with an anode wrapped about a rotating shaft or the like. As in the previous views of the embodiments, the wiper blades are slightly longer than the space between the strip surface and the anode surface so that the blade is partially flexed. It is believed preferable for the blade to be flexed just sufficiently to enable its end to ride upon the surface to be coated along one edge at the end. In other words, the wiper is preferably cut straight across at the bottom so that when flexed, it rides with an edge against the strip surface and wipes off all bubbles of hydrogen as well as any thin cathodic layer which tends to form. The coating in a continuous coating line is not usually sufficiently thick for dendritic material to begin to grow or extend from the surface. However, if the electrolytic coating is one upon which dendritic material tends to grow from the surface, the edges of the blades also very neatly shear off such dendritic material so it does not interfere with the uniformity of coating. However, as noted, in the coating of continuous blackplate or strip, the coating usually is not allowed to become thick enough for any dendritic material to form. The principal function of the wiping blade, therefore, in the process shown in FIG. 7 is first to detach bubbles of hydrogen from the coating surface and second to block any thin electrolyte depletion layer or film that may otherwise tend to travel along with the strip. Thus, as a thin surface layer of electrolyte travels through the apparatus with the strip, it contacts the stationary wiper blade which is resiliently held against the strip with sufficient force to prevent it from being displaced or lifted by the current, but not with such force that it will not be easily lifted by the coating building up on such strip so the coating will not be damaged by such wiper blade. The displaced layer of coating solution is displaced not only sidewise along the blade, but also upwardly through the openings in the anode grid. At the same time, fresh solution enters from the sides and also from the top through the openings in the electrode grid behind the blade. If the anode is more than a few inches wide, the entrance of electrolyte from the side would not be sufficient to prevent cavitation or temporary and fluctuating open spaces behind the blade and it is, therefore, important that the wiper blade be used in combination with a perforated anode, particularly as the anode strip opening is only on the order preferably of about one quarter to three eighths of an inch between the two in order to attain maximum efficiency.

The wiper blades 131 are shown in FIG. 7 as having an upper mount 133 into which they extend or which is integral with the blade itself and such upper mount is then attached, preferably to the anode, by threaded fasteners which may pass through fastening openings in the anode and may be secured with a threaded nut. It is preferred to have the upper mount 133 made from the same electrolyte-resistant plastic and to have the threaded fastener 135 in the form of a stud made from the same plastic material or other plastic material which may be threaded into the upper mounting block on one end and have the other end passed through an orifice in the lead or other composition anode and secured by a threaded nut 137.

Other forms of securing mechanism or means can be used, such as, for example, the interengagement means shown in FIG. 2 which comprises partially expanded jam fit means which may be an integral part of the upper section of the blade material itself. The expanded sections 33 shown in FIG. 2, of course, operate best if the openings in the grid-type electrode are approximately the same size both longitudinally and transversely as the dimensions of the snap-type jam fittings on the blade itself. Since the material of the blade is desirably rather thin in order to have satisfactory flexibility in a short length, such as the close spacing of the cathodic workpiece and anode surfaces demands, an orifice in the anode both large enough to provide the necessary electrolyte flow from top to bottom and vice versa, may be difficult to arrange, particularly if it must also be the correct size for maintaining a secure interlock with the upper portions of the blade. The use of the threaded securing means shown broadly in FIGS. 7A and 7B, and more particularly in FIGS. 8 through 15 described below, thus is desirable, so far as preciseness and non-interference with the openings in and flow of electrolyte through the anode is concerned. A combination flanged sectionalized anode-slotted wiping blade assembly, shown more particularly in FIGS. 21 through 25 described hereinafter, is also very desirable.

Figures 7A, 7B, 9, 10, 18, 19, 20:
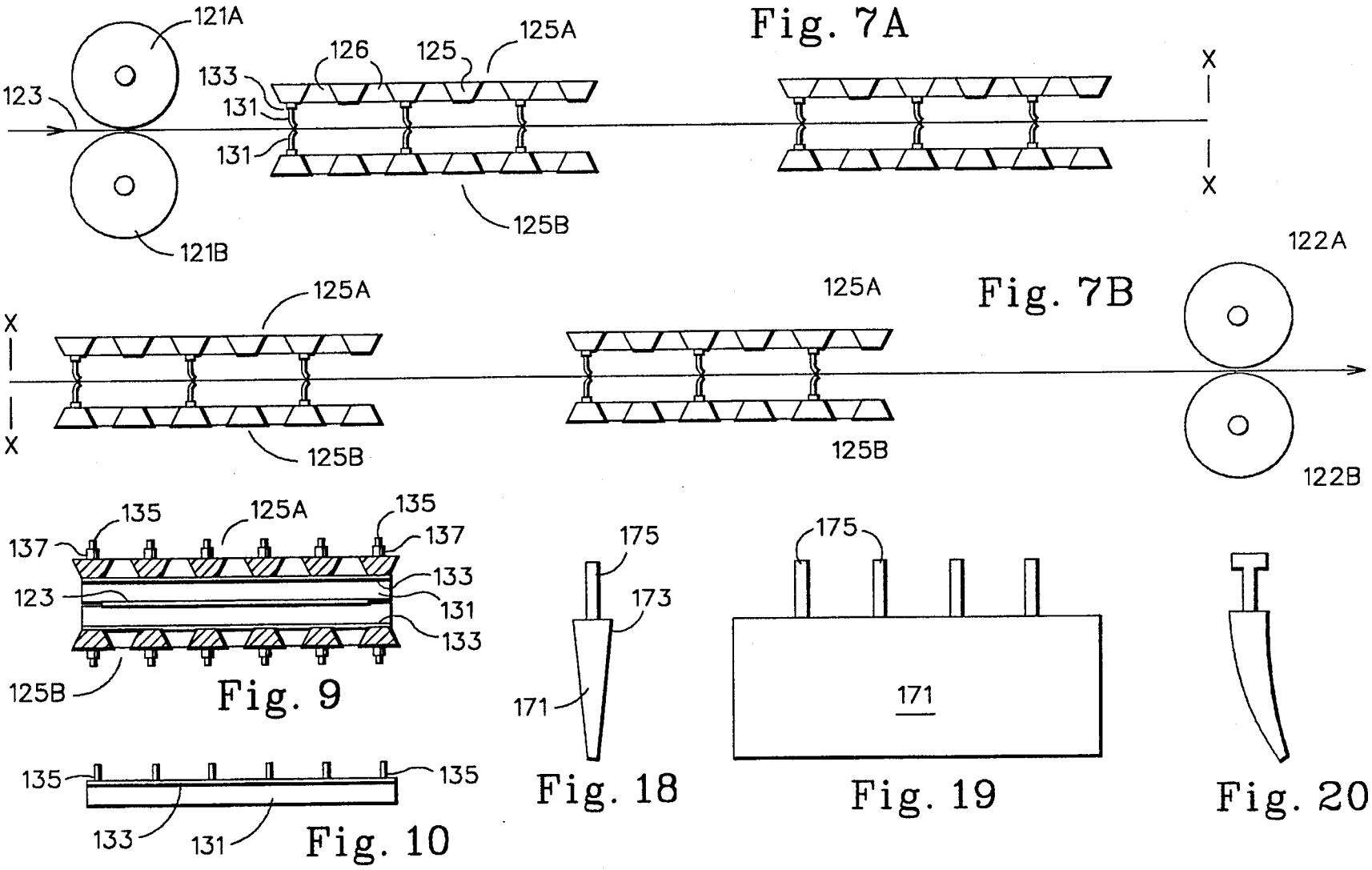
FIGS. 7A and 7B are diagrammatic elevations of a continuous plating line equipped in accordance with the invention with an alternative form of the wiper blade of the invention.
FIG. 9 is a transverse section through the portion of the continuous coating line of FIG. 7B at 9—9.
FIG. 10 is an enlarged side view of one of the wiper blades used in the continuous coating line shown in FIGS. 7A through 9.
FIG. 18 is an end view of an alternative tapered wiping blade in accordance with the present invention.
FIG. 19 is a side view or elevation of the tapered wiping blade shown in FIG. 18.
FIG. 20 is a side view of an alternative tapered construction wiping blade in accordance with the invention.
Figure 8:
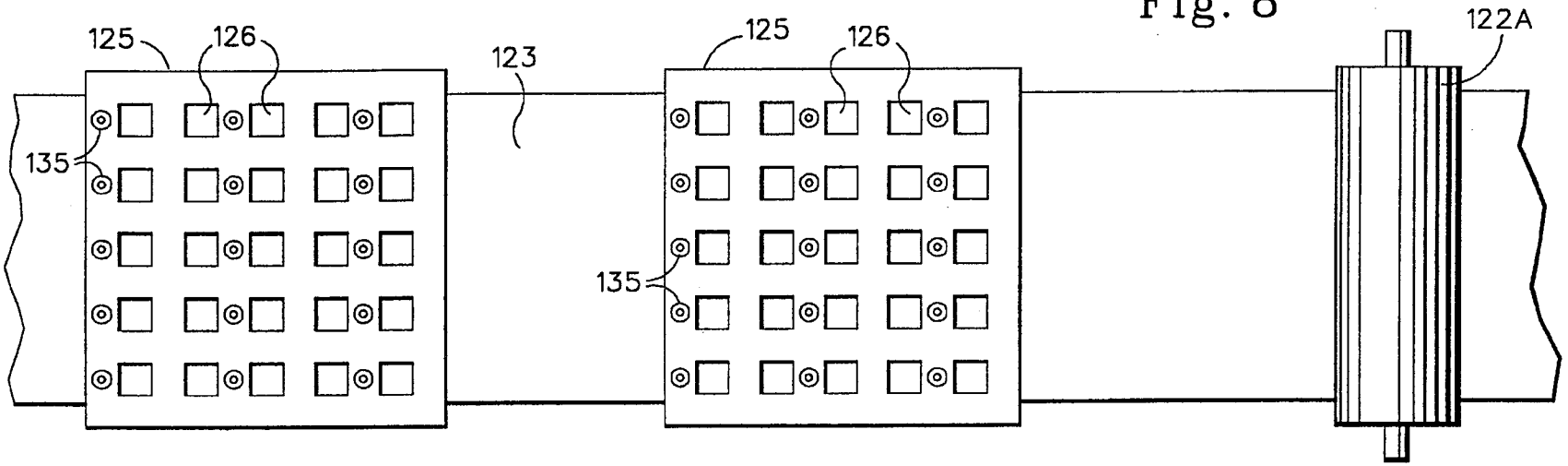
FIG. 8 is a diagrammatic plan view of the portion of the continuous coating line shown in FIG. 7B.

FIG. 8 is a diagrammatic plan view of the arrangement shown in FIG. 7B showing the top of the grid-type electrodes 125 positioned over the strip 123 plus one of the guide rolls 122*a* at one end of the plating tank, the tank itself again not being shown. The openings or orifices 126 in the tops of the grid-type anodes are clearly visible as are the tops of threaded fastenings 135 and threaded nuts 137 upon them which hold the upper mounts 133 of each of the wiper blades 131 to the lower surface of the upper anode 125*a*. The same arrangement would be present upon the upper surface of the lower anode 125*b*.

Figure 11:
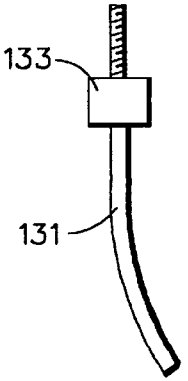
FIG. 11 is an enlarged side view of the wiping blade of FIG. 10.

FIG. 9 is a cross section transversely through an upper and lower grid-type electrode 125*a* and 125*b* as well as the strip 123 along the section 9—9 in FIG. 7B showing the wiping blades of the invention bearing upon the surface of the strip while FIG. 10 is a side view of one of the wiper blades by itself prior to being affixed in place or secured to one of the anodes as shown in FIG. 9. FIG. 11 is an enlarged end view of the wiper blade 131 and mounting 133 shown in FIG. 10 by itself and in FIG. 9 mounted in place in the coating tank, not shown. The coating blade 131 is illustrated in FIG. 11 with the minor flexure which is preferred when the blade is in operative position against the strip, but it should be recognized that the blade will normally, when free standing by itself, as shown in FIG. 11, be straight rather than flexed so that when it is contacted against a surface to be coated, it will exert a small but definite back force against the surface to be coated. Such force should be sufficient, as noted above, to thoroughly remove as well as coalesce hydrogen bubbles clinging to such surface and, it is believed, nucleate into small hydrogen bubbles a cathodic film clinging to or laid down upon such surface. In addition, in the case where there is dendritic material forming upon such surface, the force of the blade should be sufficient to sever, shave off or otherwise remove such dendritic material, while at the same time not bearing upon the surface sufficiently to prevent buildup of the coating and/or to burnish or damage the coating. The degree of force should also be sufficient to prevent the surface layer of liquid electrolyte drawn along with the strip from lifting the wiper blade from the surface by the force building up in front of and under the blade, since this would allow the potentially partially depleted surface layer of electrolyte normally drawn along with the strip or other workpiece to pass at least partially under the blade to the opposite side of the wiper blade rather than being diverted from the surface and replaced by fresh electrolyte flowing in behind the blade as the strip passes under the blade. The parameters of the resiliency of the blade, therefore, are essentially the generation of sufficient force, due to resiliency either of the plastic itself or of a separate resilient biasing means, to prevent any substantial escape of liquid electrolyte under the blade and to sever thin dendritic processes, if any are present, but not sufficient to mar the coated surface or to prevent the necessary buildup of an electrolytic coating of the thickness desired upon the surface. A blade which will resist lifting by the surface layer of fluid will usually also be effective to remove bubbles of hydrogen as well as nucleate smaller quantities of hydrogen into bubbles. An immovable blade would simply constrict any upward buildup of coating, a very undesirable situation. The resiliency should also be sufficient to prevent or damp out any substantial oscillation or weaving of the strip between the sets of guide rolls 121 and 122 in a continuous coating line such as shown in FIGS. 7A and 7B and prevent possible touching and arcing of the cathodic workpiece or strip with the anode. Arcing can, of course, also occur if the anodic and cathodic surfaces approach close enough for the potential between the two to break down the natural resistance of the intervening electrolyte except by ion transport of the electric current. It is for this reason also that the wiping blade itself should not be a conductor of electricity or have a high dielectric value and should be sufficiently stiff to provide substantial and effective guidance and directional stability to the workpiece, particularly when in the form of a flexible strip or the like.

While it is preferred to rely upon the resiliency of the short, thin wiping blade itself to produce sufficient force to prevent escape of coating solution under the blade by lifting the blade and to maintain the strip centered between the electrodes, other resilient arrangements to accomplish basically the same end may be used. For example, in FIG. 12 there is shown a wiper blade 141 which is maintained straight up and down, or essentially at right angles to the coated surface, while being resiliently biased toward the cathodic surface by resilient means in a mounting 143. In this case the resilient means comprises spring means 147 in a spring chamber 145 within the mounting piece 143 isolated or blocked off from the electrolyte bath by a movable plunger 149 in which or to which the wiper blade 141 is mounted. The plunger 149 is essentially similar to the mounting 133 at the top of the wiping blade 131 as shown, for example, in FIGS. 9, 10 and 11.

Figure 13:
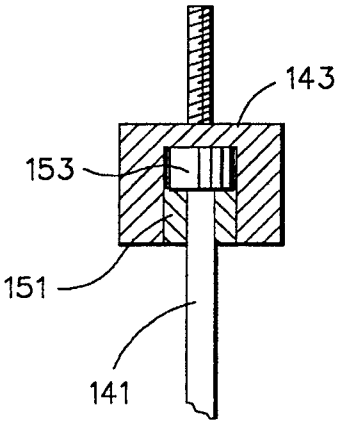
FIG. 13 is a transverse section through a still further alternative wiping blade of the invention.

A third type of resilient construction is shown in FIG. 13. In this arrangement, the wiper blade 141 passes into a slotted member 151 in the mounting 143 and abuts against a resilient plastic material contained in a resiliency chamber 153. The resilient plastic or other resilient material such as rubber or the like may be contained in the resiliency chamber 153. Such material is more resilient than the polymeric dielectric material of the wiping blade itself and is calculated to provide the resilient force necessary as explained above.

Figure 12:
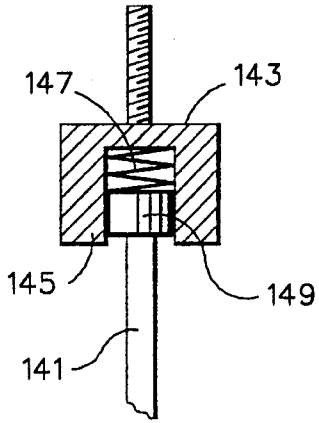
FIG. 12 is a transverse section through an alternative wiping blade.
Figure 14:
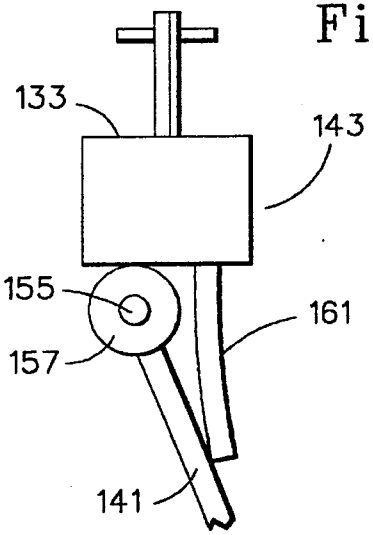
FIG. 14 is an end view of a still further alternative construction of a wiping blade in accordance with the invention.
Figure 15:
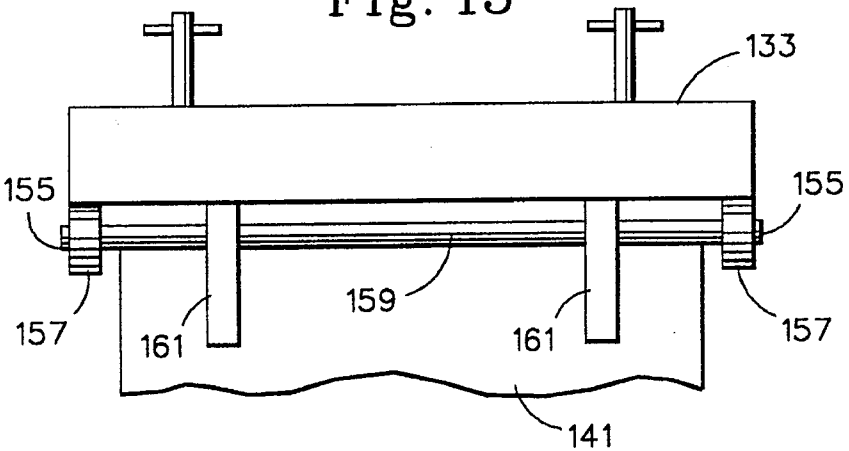
FIG. 15 is a side view of the wiping blade shown in FIG. 14.

A fourth type of resilient construction is shown in FIGS. 14 and 15 which shows a construction in which a fairly stiff plastic or dielectric blade material comprises the wiping blade 141, as in FIGS. 12 and 13, but in which the wiping blade 141 is hinged to the mounting by means of two bosses 155 at each end of the top of the blade, which bosses are accommodated in two plastic loops 157 dependent from the mounting 143. The bosses 155 may, in the construction shown, be continuations or extensions of bar or shaft 159 at the top of the blade 141 as shown, or may be extended directly from the sides of the blade 141 itself. The blade 141 will, in the arrangement shown, merely pivot on the mounting 143, and in order to provide a resilient force of the end of the blade against the strip surface, a further resilient biasing means is necessary. This is shown in FIGS. 14 and 15 as being supplied by two resilient strips of plastic 161 which are mounted in the mounting 143 and bear against the face of the blade 141 to provide it with a resilient pivoting force. In each of these embodiments, threaded fastener means shown as a threaded stud or other threaded fitting 135 and a threaded nut 137 at the end are used to secure the various constructions to the anode. However, in each case, the blades could be secured to a separate mount or the like.

Figure 16:
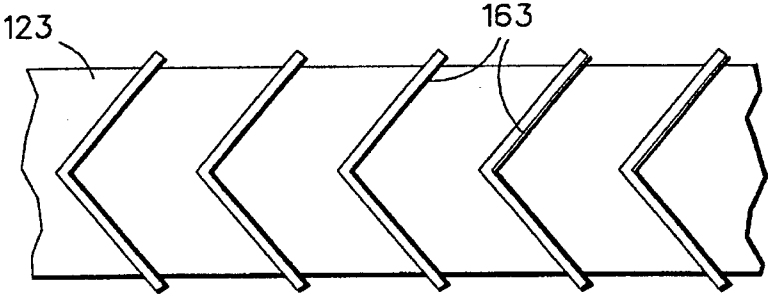
FIG. 16 is a diagrammatic plan view of an alternative form of wiping blade superimposed upon a strip being coated.

FIG. 16 shows a further design for a wiping blade in which a series of blades 163 take a chevron or triangular overall shape. Such blades will be either self resilient or may be biased toward the strip by a spring or other arrangement, not shown, but essentially as explained above. The individual chevrons may be either separately mounted or may be mounted in a single frame, not shown, which is resiliently pressed against the strip surface in any suitable manner. The mounting of ganged or individual chevrons, as in the other embodiments of the wiping blades, can be either to the closely spaced anodes or to separate mounting means so long as the mounting is secure and, as explained, properly resilient.

Figure 17:
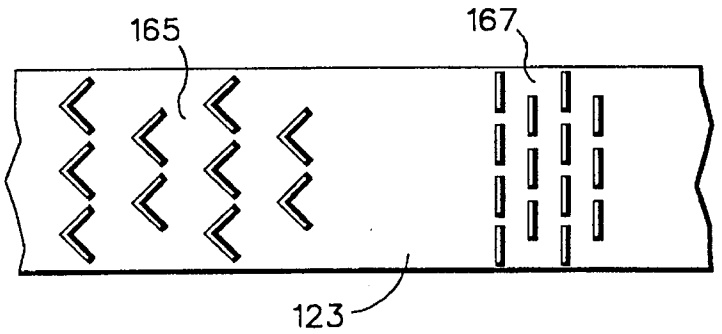
FIG. 17 is a still further diagrammatic plan view of two alternative configurations of wiping blades in accordance with the invention.

FIG. 17 is a diagrammatic plan view of a strip of black plate 123 as shown in FIG. 16, with two further possible arrangements of solid wiper blades applied to the surface of the strip as shown. In the first of these, 165, a group or collection of chevron-shaped blades extend across the strip to wipe the surface, removing hydrogen bubbles and also renewing the surface layer of electrolytic solution primarily by breaking up such surface layer. In the alternative arrangement 167 of straight, but relatively short wiper blades, the strip face is again wiped by a series of individual blades. In both arrangements, the blades, both chevron and straight, are staggered so that electrolytic solution is directed essentially from one blade to another thoroughly mixing it and essentially causing turbulence, but not necessarily stripping the entire coating surface at one time of its associated electrolytic solution. The arrangement is particularly useful where perforated, or grossly perforated, anodes may not be readily available for use with the blades or where it is desired to have a more gradual replacement of the surface layer of electrolytes.

In the case of the chevron-shaped blades, the angled blade tends more forcefully to force the electrolytic solution to the side, somewhat in the manner of a snowplow. This is somewhat more effective in immediately removing any dendritic material from the coating surface, but probably does not interchange electrolytic solution any faster, since there must be sufficient openings in the anode to allow ready back flow of solution behind the wiper blade to avoid cavitation, which openings are then also adequate to allow flow from in front of the blade. Despite the angle of the blade in the snowplow arrangement, movement of the work surface past the blade can still be considered to be substantially transverse with respect to the blade.

FIGS. 18 and 19 are end and side views, respectively, of an improved tapered wiping blade 171 in which the top portion 173 of the blade is expanded in size and preferably has a series of thin pins 175 extending from it. This blade can be attached to an anode by inserting the pins into pre-drilled holes in the anodes and when it is desired to replace a blade, it can be easily pried out with a prying tool of proper design and a new blade popped into place. The bottom of the blade is tapered so that it is properly flexible or resilient to bear against the surface of the strip and may be pre-flexed, if desired, as shown, in the proper direction.

FIG. 20 is a side view of a further wiping blade 171 also having a tapered and pre-flexed contour and having, in addition, a pin having a slight expansion at the top so that when popped into place in pre-drilled holes in the anode, it will be held securely in place until pried out after wear of the end of the blade is detected. Alternatively, if the enlarged top is made larger together usually with the pin itself, the enlarged pins may be jammed into the flow orifices in the anode to hold the blade somewhat as shown in FIGS. 1 and 2. However, this has the disadvantage of blocking the flow orifices in the area in which flow may be most desirable to renew the solution.

As has been explained above, the resilient plastic or dielectric wiper blades of the invention very effectively wipe the surface of a cathodic workpiece while electrolytic coating is taking place by relative movement with respect to the surface of the coating piece. Normally, the wiping blade will be held stationary, but resiliently biased against the workpiece, as shown in the various appended drawings, but it will be understood that the wiper blade can be designed to move across the work surface also. Usually in such case there would be a reciprocating motion of the wiper blade or blades somewhat in the manner of a windshield wiper on a car. In most such instances, a fairly stiff blade may be used and depended directly against the coating surface by a resilient means.

It has also been found possible to incorporate a very fine abrasive within the plastic of the wiper blade itself in order to, in some instances, partially abrade the surface of the coating as it is laid down. This arrangement does not normally have much application in the continuous wiping of a flat workpiece such as strip or the like where the coating is customarily made very thin, in any event, and does not have much chance to become rough during the coating process. However, in those coatings where a heavy coated surface is desired, such as in chromium plating to repair a worn or otherwise defective surface, the surface which is subject also to dendritic growth and other uneven growth may require grinding down with abrasives periodically before continuing with the coating and in such instances, the continuous abrading of the surface with very fine abrasive particles in the range of about 2 to 10 microns in size, more or less, usually will provide continuous abrasion, helping to maintain the surface smooth, and in the best circumstances, eliminating the need for intermediate grinding completely. In such instances, the abrasive particles may be used either in all wiping blades or in only some of the blades, depending upon the circumstances.

FIG. 21 is a transverse cross section of an improved arrangement for an integrated perforated anode and wiping blade arrangement or structure in which the perforated anode is sectionalized and provided with opposing flanges between the sections by which such sections may be secured to each other. The plastic wiping blades are positioned between the flanges and secured by the same fastenings as secure together the flanges. Such an arrangement not only provides an integrated structure, but a stronger structure overall and, if the wiping blades are slotted, allows such blades also to be adjusted periodically for wear. In FIG. 21 a curved or circumferential perforated anode 181 is seen to be divided into three sections 181*a*, 181*b* and 181*c* which together encompass a round, or cylindrical, workpiece 183 which, it will be understood, will be arranged to rotate within the center of the anode 181. The sections 181*a*, 181*b* and 181*c* each has an outwardly extending flange 185 at each end, which flange, it will be understood, is perforated with fastening holes or orifices through which threaded bolt type or other suitable fastenings 187 are passed to hold the sections together in a unitary structure as well as to secure the dielectric wiper blades 189 between the sections. As in the earlier described structures set forth above, the dielectric wiper blades 189 aid in centering the rotating steel workpiece within the closely confining anode 181 comprised of the sections 181*a*, 181*b* and 181*c* which are maintained fairly close to the surface of the workpiece. For this reason there are preferably at least three more or less equally spaced wiper blades and adjacent flanges so that the workpiece is maintained centered by three wiper blades within the anode structure, or, looked at in another way, the anode structure is kept centered about the workpiece. A further frequent arrangement will also be to divide the anode structure into quarter sections, in which case there will be four wiper blades, which will even better maintain concentricity and avoid touching and arcing between the anode and cathodic workpiece. Additional wiper blades may be used, depending upon the size and speed of movement of the workpiece. As in earlier figures, the wiper blades are shown inclined slightly in the direction the cylindrical workpiece is rotating. Preferably one edge of the end of the wiper blade contacts the surface of the workpiece, but this is only preferable where the surface is to be stripped of outwardly growing dendritic material, for example, in the plating of the workpiece with hard chromium or the like.

As indicated above, the arrangement shown in FIG. 21 is a convenient way to allow adjustment of the wiper blades as wiping proceeds. In FIG. 22 there is shown a longitudinal view of one of the wiper blades 189. In FIG. 22 the wiper blade 189 has round orifices 191 in it through which the fastenings 187 may be passed to hold the wiping blades tightly between the flanges 185 of the anode sections 181. The wiper blade is not adjustable, but is strongly and securely held in place. On the other hand, in FIG. 23 there is shown a variation of the wiper blade 189 having oblong orifices or slots 193 through it for receipt of the fastenings 187. The slots are preferably spaced several inches apart. The slotted arrangement of FIG. 23 enables the blade to be adjusted vertically between the flanges 185 as the wiping blade wears or even to some extent as different diameter workpieces are coated within the anode sections. However, normally the degree of adjustment for various workpiece diameters is rather limited, because of the limited width of the wiper blades and their decreasing rigidity as they extend farther from the anode. It will usually be the case that the anode will be withdrawn from the coating solution for adjustment of the wiper blade, but in some cases a suitable mechanism, not shown, for periodic adjustment of the wiping blade may be mounted upon or adjacent to the top of the blade to make an automatic adjustment or even a manual adjustment of the wiper blade without removing the entire structure from the coating solution.

In FIGS. 24 and 25 respectively, there are shown a diagrammatic side elevation and a diagrammatic plan view of a perforated anode and plastic wiping blade combination construction for use in the continuous plating of strip or sheet. As shown, a single anode 195 may be divided, for example, into six more or less equal sized sections with upstanding flanges 197 between the sections between which dielectric wiper blades 199 are mounted. Such flanges 197 and wiper blades 199 are connected or secured together by means of fastenings 201, which may be threaded or other suitable fastening. Each anode section is provided with a plurality of more or less randomly, but closely spaced orifices 201 through which coating solution may have free passage, particularly, as explained above, as the wiper blades 199 force a surface layer of solution away from the surfaces of the traveling strip 203. As explained previously, such solution will be forced by the movement of the strip past the wiping blade out the sides of the space between the anodes and the workpiece between the blades, but also up through the anode orifices in front of the blade, while other solution passes through the orifices at the back of the wiping blade as well as in from the sides to take the place of the previous solution, thus ensuring a periodic renewal of the electrolytic next to the surface of the workpieces.

As will be understood, the combined anode-wiper blade structures shown in FIGS. 21 through 25 provides a strong convenient and highly practical arrangement which has several advantages over the wiper blade construction shown in previous views. The arrangement is particularly sturdy and effective in securely holding the wiper blades in position. It's main disadvantage is that the blades are not readily replaceable without disassembling the entire structure, although, as indicated, arrangements can be made for moving slotted or otherwise appropriately constructed wiping blades to adjust them automatically or at least manually without removal of the anode from the coating solution. Such arrangements, however, create additional complexity and the more conveniently replaced snap-in-type wiping blades shown in some previous views may be, therefore, more desirable in some operations.

It was previously mentioned above, that it may be desirable in some cases, and particularly where a coating deposite must be laid down consecutively, as is the case in almost all heavy electrolytic coatings, and in which case the coating must usually be ground between coating passes to maintain a smooth coating surface for further coating, to provide included abrasive material in the plastic of the wiping blades, or at least some of the wiping blades, so that the passage of the blade over the previously laid down coating surface acts to smooth such surface for further coating. For this purpose fine abrasive in the range of, for example, two to ten microns may be provided within the structure of the extruded blade or at least along the contacting edge. Such an abrasive filled wiping blade is shown in cross section in FIG. 26 in which a wiping blade 205, shown diagrammatically in cross section, has an orifice 207 for mounting as in FIGS. 21 through 25 and is provided with fine abrasive particles in the region of the tip of the blade. As the blade wears, therefore, additional abrasive is brought to the surface and grinds and abrades the surface of the coating, serving to keep it smooth. By the use of the abrasive filled wiping blades a continuous smoothing and polishing operation is accomplished simultaneously with the electrolytic coating which smoothing and polishing in some cases may completely eliminate the need to grind the surface in a separate operation as the coating process proceeds. The abrasive material included in the wiping blade may be silicon carbide or aluminum oxide abrasive particles of suitable size coextruded with the polymeric resin from which the wiping blade is formed.

As set forth above, it has been discovered that the use of the wiper blades of the invention provide very superior coatings and that their use in a process considerably increases the rate of coating by very effective removal of hydrogen bubbles which will otherwise partially occlude the surface and with some coatings, by shaving off or otherwise removing dendritic material in those cases where such material is a problem. In addition, and very importantly in many cases, the wiping blade also improves the coating operation by stripping away a surface layer of partially depleted electrolytic coating solution and causing new electrolytic solution to be brought down to the coating surface. In order to effectively achieve the renewal of the coating solution next to the coating piece, the wiping blade of the invention should be used in combination with a properly perforated anode through which the electrolytic coating solution can pass. The blade should also be resilient enough to exert a downward force sufficient to prevent the counter force of any thin surface or depletion layer of electrolyte carried along with the workpiece surface from lifting the blade from the coating surface, but not with sufficient downward force to mar the coated surface or interfere with the buildup of a smooth, even coating.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

We claim:

1. An improved arrangement for electrolytic coating comprising:

(a) means to support a cathodic workpiece having at least one surface to be coated within containment means for an electrolytic solution containing metallic ions to be plated out upon and bathing such surface to be coated, (b) an anode mounted closely adjacent the support position of said cathodic workpiece within said containment means for contact with said electrolytic solution, (c) at least one thin substantially planar resilient laterally extended contact wiper means arranged to resiliently contact the surface of the cathodic workpiece to be coated along an extended narrow contact interface between said surface of the workpiece and one edge of the resilient extended wiper means while submersed in the electrolytic solution, (d) means to move the cathodic workpiece and resilient extended wiper means relative to each other substantially transverse to the resilient extended wiper means, (e) means to replenish electrolytic solution within the body of solution to prevent said body of electrolytic solution from becoming depleted of coating metal, and (f) wherein there are a plurality of laterally extended contact wiper means having contact portions not more than one-eighth inch in thickness disposed at intervals arranged to move periodically over the coating surface mounted adjacent to a perforated anode such that as the extended contact wiping blade passes along the surface of the workpiece, old electrolytic solution is forced through the orifices in the anode and new electrolytic solution passes through the orifices and fills in behind the blade prior to the formation of a detrimental depletion layer adjacent the surface of the workpiece.

2. An improved arrangement for electrolytic coating in accordance with claim 1 wherein the resilient laterally extended contact wiper means comprises strips of resilient plastic resistant to the electrolytic solution mounted with one edge deflected against the surface of the cathodic workpiece to be coated.

3. An improved arrangement for electrolytic coating in accordance with claim 2 wherein the resilient laterally extended contact wiper means is between one eighth and one sixteenth inch in thickness along the edge deflected against the surface to be coated.

4. An improved arrangement for electrolytic coating in accordance with claim 2 wherein the portion of the laterally extended contact wiper means opposite to the deflected edge are disposed substantially perpendicularly to the perforated anode from which said contact wiper means are supported.

5. An improved wiping means in accordance with claim 4 wherein the plastic blade is gradually tapered from top to bottom.

6. An improved arrangement for electrolytic coating in accordance with claim 1 wherein the resilient laterally extended contact wiper means comprise strips of plastic resistant to the electrolytic solution resiliently mounted to bear along one edge directly upon the surface to be coated.

7. An improved arrangement for electrolytic coating in accordance with claim 1 wherein a resilient biasing means is in contact with the laterally extended contact wiper means to bias the edge of said wiper means against the surface to be coated.

8. An improved arrangement for electrolytic coating in accordance with claim 7 in which the resilient biasing means biases the laterally extended contact wiper means about an angle to enable the edge to contact the surface to be coated.

9. An improved arrangement for electrolytic coating in accordance with claim 7 in which the resilient biasing means biases the laterally extended contact wiper means parallel to the plane of the wiper means to contact said edge against the surface to be coated.

10. An improved arrangement for electrolytic coating in accordance with claim 1 wherein the resilience of the thin, substantially planar wiper means is sufficient such that when such planar wiper means is placed with its narrow contact interface against the surface of the cathodic workpiece substantially transverse to the relative movement of the workpiece and the longitudinal extent of the wiper means, sufficient force will be generated by the resiliency of the wiper blade to prevent any substantial passage of liquid electrolyte across the narrow contact interface, but insufficient to mar or damage the coated surface.

11. An improved arrangement for electrolytic coating in accordance with claim 10 wherein there are a plurality of at least nominally opposed planar wiper means on opposite sides of the workpiece and the resilience of the wiper means is sufficient to damp out any substantial transverse oscillation of the workpiece from side to side.

12. An improved arrangement for electrolytic coating in accordance with claim 11 wherein the planar wiper means are deflected along the edge against the work surface to provide the necessary force to prevent passage of electrolyte and damp out transverse oscillations.

13. A method of electrolytic coating comprising:

(a) spacing an anode and a cathodic workpiece in close proximity to each other with a dielectric spacer material in the form of a series of thin substantially planar laterally extended contact blades mounted between said anode and cathodic workpiece within a liquid containing space with one edge of the contact blades contacting the cathodic workpiece surface along an extended narrow contact interface, (b) establishing a charge between the anode and cathodic workpiece, (c) establishing relative motion between the anode and the cathodic workpiece, and (d) at the same time wiping the surface of the workpiece with the think, substantially planar laterally extended contact blades mounted adjacent the anode as the strip passes the anode, and (e) wherein the contact blades are not greater than one-eighth inch in thickness in the contacting portions of the blades and wherein the anode is perforated to form orifices through which electrolytic coating solution may readily pass and the laterally extended contact blades force electrolyte from in front of the blades through the orifices in the anode in front of the blades and draws fresh solution through orifices in the anode behind the blades to the coating surface as the blade and the cathodic workpiece move relative to each other.

14. A method of electrolytic coating in accordance with claim 13 wherein the electrolyte contains chromium ions and the contact blades sever dendritic material extending from the coated surface as well as displacing bubbles of hydrogen from the surface.

15. A method of electrolytic coating in accordance with claim 14 wherein the contact blade incorporates fine abrasive particles and polishes the surface of the cathodic workpiece as each of the blades pass over such surface.

16. An improved wiping means for wiping the surface of workpieces during electrolytic coating comprising:

(a) a thin, substantially laterally extended plastic blade having a laterally extended coating contact surface along one edge, (b) means spaced along an opposite edge of the blade interengaging with openings in a perforated coating anode, to which the plastic blade is secured (c) said blade incorporating resilient characteristics adjacent one of the edges and a restricted narrow contact interface area for contacting the coating surface of a workpiece along one of the edges, and (d) wherein the resilience of the thin, substantially planer plastic blade is sufficient such that when such means is placed with its restricted narrow contact interface against the surface of the cathodic workpiece substantially transverse to the relative movement of the workpiece and the longitudinal extent of the wiper means, sufficient force will be generated by the resiliency of the wiper blade to prevent any substantial passage of liquid electrolyte across the narrow contact interface, but insufficent to mar or damage the coated surface and electrolyte will be urged by passage of the resilient blade through adjacent openings in the perforated anode.

17. An improved wiping means in accordance with claim 16, wherein the restricted contact interface area along one of the edges is also the resilient portion of the plastic blade and is not greater than one-eighth inch in thickness.

18. An improved wiping means in accordance with claim 17 wherein the resilience of the plastic blade against the workpiece is transversely oriented with respect to the blade.

19. An improved wiping means in accordance with claim 16 wherein the edge of the blade having resilient characteristics is the opposite edge from the restricted contact interface area along one edge.

20. An improved wiping means in accordance with claim 19 wherein the resilient characteristics along one edge of the blade are arranged to act parallel to the plane of the blade to urge the blade against the surface of the workpiece.

21. An improved wiping means in accordance with claim 16 wherein there are a plurality of at least nominally opposed plastic blades on opposite sides of the workpiece and the resilience of such plastic blades is sufficient to damp out any substantial transverse oscillation of the cathodic workpiece from side to side.

22. An improved wiping means in accordance with claim 21 wherein the plastic blades are deflected along the edge against the work surface to provide the necessary force to prevent passage of electrolyte and damp out transverse oscillations of the cathodic workpiece.

23. An improved wiping means in accordance with claim 16 wherein the plastic blade is larger at the top than at the bottom along the restricted contact interface.

24. An improved electrolytic coating surface wiper and anode arrangement comprising:

(a) an anode having a plurality of orifices through the anode through which electrolytic solution can effect substantially free passage, (b) the anode being sectionalized into separate sections with flanges at least at one end of the sections, (c) a thin, substantially planar dielectric resilient wiping blade means mounted between the flanges of adjacent sections of the anode such that a portion of the wiping blade extends away from the anode to directly contact the surface of a cathodic workpiece passing adjacent to the anode, and (d) securing means to secure the flanges of adjoining sections of anode together with the wiping blade means between them into a unitary structure, and (e) the section of the planer resilient wiping blade which directly contacts the cathodic workpiece being not greater in thickness than one-eighth inch.

25. An improved electrolytic coating surface wiper and anode arrangement in accordance with claim 24 wherein the dielectric wiper blades are slotted to allow vertical adjustment of such blades relative to the anode structure to adjust and maintain contact with the workpiece surface.

26. An improved electrolytic coating surface wiper and anode arrangement in accordance with claim 25 additionally comprising fine abrasive material included in at least the section of the wiping blade adjusted for smoothing a contacted surface.

27. An improved electrolytic coating surface wiper and anode arrangement in accordance with claim 22 wherein the resilience of the thin, elongated, substantially planar wiping blade means is sufficient such that when such means is placed with its narrow contact interface against the surface of the cathodic workpiece substantially transverse to the relative movement of the workpiece and the longitudinal extent of the wiper means, sufficient force will be generated by the resiliency of the wiper blade to prevent any substantial passage of liquid electrolyte across the narrow contact interface, but insufficient to mar or damage the coated surface.

28. An improved electrolytic coating surface wiper and anode arrangement in accordance with claim 27 wherein there are a plurality of at least nominally opposed planar wiping blades on opposite sides of the workpiece and the resilience of such wiping blades is sufficient to damp out any substantial transverse oscillation of the workpiece from side to side.

29. An improved electrolytic coating surface wiper and anode arrangement in accordance with claim 28 wherein the wiping blades are deflected along the edge against the work surface to provide the necessary force to prevent passage of electrolyte and damp out transverse oscillations.

30. An improved arrangement for electrolytic coating comprising:

(a) means to support a cathodic workpiece having at least one surface to be coated within containment means for an electrolytic solution containing metallic ions to be plated out upon and bathing such surface to be coated, (b) an anode mounted closely adjacent the support position of said cathodic workpiece within said containment means for contact with said electrolytic solution, (c) at least one thin resilient laterally extended contact wiper means arranged to resiliently contact the surface of the cathodic workpiece to be coated along an extended narrow contact interface between said surface of the workpiece and one edge of the resilient extended wiper means while submersed in the electrolytic solution, (d) means to move the cathodic workpiece and resilient extended wiper means relative to each other substantially transverse to the resilient extended wiper means, (e) means to replenish electrolytic solution within the body of solution to prevent said body of electrolytic solution from becoming depleted of coating metal, and (f) wherein there are a plurality of laterally extended contact wiper means having contact portions not more than one-eighth inch in thickness disposed at intervals arranged to move periodically over the coating surface mounted adjacent to a perforated anode such that as the extended contact wiping blade passes along the surface of the workpiece, old electrolytic solution is forced through the orifices in the anode and new electrolytic solution passes through the orifices and fills in behind the blade prior to the formation of a detrimental depletion layer adjacent the surface of the workpiece.

31. An improved arrangement for electrolytic coating in accordance with claim 30 wherein the thin resilient laterally extended contact wiper means has a configuration and dimension allowing it to be deflected to one side against the surface of the workpiece.

32. An improved arrangement for electrolytic coating in accordance with claim 30 wherein the thin resilient laterally extended wiper means are formed with an expanded top portion to which fastening means are attached and the lower work contacting portion is not greater than one-eighth inch in thickness.

33. An improved arrangement for electrolytic coating in accordance with claim 32 wherein the wiper means has a gradually tapered cross section wider at the top and tapering to a resilient narrow work contacting section at the bottom.

34. An improved arrangement for electrolytic coating comprising:

(a) means to support a cathodic workpiece having at least one surface to be coated within containment means for an electrolytic solution containing metallic ions to be plated out upon and bathing such surface to be coated, (b) an anode mounted closely adjacent the support position of said cathodic workpiece within said containment means for contact with said electrolytic solution, (c) at least one thin resilient laterally extended contact wiper means arranged to resiliently contact the surface of the cathodic workpiece to be coated along an extended narrow contact interface between said surface of the workpiece and one edge of the resilient extended wiper means while submersed in the electrolytic solution, (d) means to move the cathodic workpiece and resilient extended wiper means relative to each other substantially transverse to the resilient extended wiper means, (e) means to replenish electrolytic solution within the body of solution to prevent said body of electrolytic solution from becoming depleted of coating metal, (f) wherein the resilience of the thin, substantially planar wiper means is sufficient such that when such wiper means is placed with its narrow contact interface against the surface of the cathodic workpiece substantially transverse to the relative movement of the workpiece and the longitudinal extent of the wiper means, sufficient force will be generated by the resiliency of the wiper blade to prevent any substantial passage of liquid electrolyte across the narrow contact interface, but insufficient to mar or damage the coated surface, and (g) wherein there are a plurality of at least nominally opposed wiper means on opposite sides of the workpiece and the resilience of the wiper means is sufficient to damp out any substantial transverse oscillation of the workpiece from side to side.

35. An improved arrangement for electrolytic coating in accordance with claim 34 wherein the wiper means are deflected along the edge against the work surface to provide the necessary force to prevent passage of electrolyte and damp out transverse oscillations.

* * * * *